US010641198B2

(12) United States Patent
Takase

(10) Patent No.: US 10,641,198 B2
(45) Date of Patent: May 5, 2020

(54) CONTROLLER FOR INTERNAL COMBUSTION ENGINE, INTERNAL COMBUSTION ENGINE, AND CONTROL METHOD OF INTERNAL COMBUSTION ENGINE

(71) Applicant: Toyota Jidosha Kabushiki Kaisha, Toyota-shi, Aichi-ken (JP)

(72) Inventor: Kohei Takase, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 15/896,573

(22) Filed: Feb. 14, 2018

(65) Prior Publication Data

US 2018/0238262 A1 Aug. 23, 2018

(30) Foreign Application Priority Data

Feb. 17, 2017 (JP) ..... 2017-028242

(51) Int. Cl.

| | |
|---|---|
| ***F02D 41/38*** | (2006.01) |
| ***F02M 55/02*** | (2006.01) |
| ***F02M 55/00*** | (2006.01) |
| ***F02M 57/02*** | (2006.01) |
| ***F02D 41/24*** | (2006.01) |
| *F02M 59/36* | (2006.01) |

(52) U.S. Cl.

CPC ..... *F02D 41/3836* (2013.01); *F02D 41/2451* (2013.01); *F02M 55/002* (2013.01); *F02M 55/02* (2013.01); *F02M 57/025* (2013.01); *F02M 57/026* (2013.01); *F02D 2200/0602* (2013.01); *F02D 2200/0606* (2013.01); *F02D 2250/31* (2013.01); *F02M 59/366* (2013.01)

(58) Field of Classification Search

CPC ..... F02M 57/025; F02M 57/026; F02D 41/3863; F02D 41/3872

See application file for complete search history.

(56) References Cited

U.S. PATENT DOCUMENTS 4,185,779 A * 1/1980 Watson ..... F02M 57/025 123/472
4,219,154 A * 8/1980 Luscomb ..... F02M 57/025 123/457
5,819,704 A * 10/1998 Tarr ..... F02M 47/027 123/467
5,852,997 A * 12/1998 Vanderpoel ..... F02M 45/04 123/446

(Continued)

FOREIGN PATENT DOCUMENTS

JP 2000-234543 A 8/2000
JP 2003-106235 A 4/2003

(Continued)

*Primary Examiner* — Kevin R Steckbauer
(74) *Attorney, Agent, or Firm* — Dinsmore & Shohl LLP

(57) ABSTRACT

When a pressure of fuel is intensified using a pressure intensifier, an electronic control unit is configured to set a target common rail pressure to be higher as a fuel leakage volume that is a volume of fuel leaking from a common rail to a fuel tank becomes larger until a three-way valve is switched from a state in which the pressure intensifier is connected to the common rail to a state in which the pressure intensifier is connected to the fuel tank.

7 Claims, 16 Drawing Sheets

(56) References Cited

U.S. PATENT DOCUMENTS 6,427,664 B1 * 8/2002 Boecking ..... F02M 59/105 123/446
6,497,217 B2 * 12/2002 Kojima ..... F02M 37/0029 123/456
6,619,263 B1 * 9/2003 Mahr ..... F02M 41/16 123/447
6,889,659 B2 * 5/2005 Magel ..... F02M 57/025 123/446
6,928,986 B2 * 8/2005 Niethammer ..... F02M 57/025 123/467
7,093,582 B2 * 8/2006 Magel ..... F02M 47/027 123/446
7,128,058 B2 * 10/2006 Yamamoto ..... F02M 47/027 123/495
7,156,076 B2 * 1/2007 Holl ..... F02M 59/366 123/446
7,216,815 B2 * 5/2007 Magel ..... F02M 47/027 123/446
7,219,659 B2 * 5/2007 Magel ..... F02M 47/027 123/514
7,249,591 B2 * 7/2007 Shibata ..... F02M 47/027 123/446
7,278,398 B2 * 10/2007 Magel ..... F02M 47/027 123/446
7,320,311 B2 * 1/2008 Futonagane ..... F02D 41/3836 123/446
7,370,636 B2 * 5/2008 Futonagane ..... F02M 45/12 123/446
7,404,393 B2 * 7/2008 Moore ..... F02M 45/04 123/446
7,506,635 B2 * 3/2009 Omae ..... F02M 63/0015 123/467
8,161,947 B2 * 4/2012 Kuhnke ..... F02M 63/027 123/447
8,196,844 B2 * 6/2012 Kiss ..... F02M 47/027 123/446
8,245,694 B2 * 8/2012 Kuhnke ..... F02M 47/027 123/447
8,282,020 B2 * 10/2012 Kiss ..... F02M 47/027 239/124
9,181,890 B2 * 11/2015 Sturman ..... F02M 51/061
9,394,857 B2 * 7/2016 Yudanov ..... F02M 63/022
10,072,622 B2 * 9/2018 Yamada ..... F02D 41/3082
2001/0054412 A1 * 12/2001 Kojima ..... F02M 37/0029 123/456
2004/0195387 A1 * 10/2004 Magel ..... F02M 57/025 239/533.2
2005/0145221 A1 * 7/2005 Niethammer ..... F02M 57/025 123/446
2005/0241616 A1 * 11/2005 Holl ..... F02M 59/366 123/446
2006/0005815 A1 * 1/2006 Magel ..... F02M 47/027 123/446
2006/0042597 A1 * 3/2006 Magel ..... F02M 47/027 123/446
2006/0042598 A1 * 3/2006 Magel ..... F02M 47/027 123/446
2006/0065241 A1 * 3/2006 Yamamoto ..... F02M 47/027 123/446
2006/0144367 A1 * 7/2006 Futonagane ..... F02D 41/3836 123/446
2006/0150954 A1 * 7/2006 Moore ..... F02M 45/04 123/446
2006/0157581 A1 * 7/2006 Kiss ..... F02M 47/027 239/88
2006/0162695 A1 * 7/2006 Shibata ..... F02M 47/027 123/446
2006/0196474 A1 * 9/2006 Magel ..... F02M 47/027 123/446
2006/0202140 A1 * 9/2006 Magel ..... F02M 47/027 251/30.01
2008/0029066 A1 * 2/2008 Futonagane ..... F02M 45/12 123/456
2008/0047527 A1 * 2/2008 Sun ..... F02M 57/025 123/446
2008/0264383 A1 * 10/2008 Omae ..... F02M 63/0015 123/445
2009/0159048 A1 * 6/2009 Yamada ..... F02M 47/027 123/447
2010/0132667 A1 * 6/2010 Kuhnke ..... F02M 47/027 123/446
2010/0212636 A1 * 8/2010 Kuhnke ..... F02M 59/105 123/447
2012/0080110 A1 * 4/2012 Kiss ..... F02M 47/027 137/625.48
2014/0138454 A1 * 5/2014 Sturman ..... F02D 41/20 239/5
2015/0068496 A1 * 3/2015 Yudanov ..... F02D 41/3863 123/456
2016/0319784 A1 * 11/2016 Yamada ..... F02D 41/3082
2018/0195460 A1 * 7/2018 Ikemoto ..... F02M 63/023
2018/0291831 A1 * 10/2018 Hirano ..... F02D 41/3836

FOREIGN PATENT DOCUMENTS

JP 2005-248722 A 9/2005
JP 2006-132441 A 5/2006
JP 2007-255306 A 10/2007
JP 2007255306 A * 10/2007 ..... F02D 41/04

* cited by examiner

CONTROLLER FOR INTERNAL COMBUSTION ENGINE, INTERNAL COMBUSTION ENGINE, AND CONTROL METHOD OF INTERNAL COMBUSTION ENGINE

CROSS-REFERENCE TO RELATED APPLICATIONS

This application claims priority to Japanese Patent Application No. 2017-028242 filed on Feb. 17, 2017, incorporated herein by reference in its entirety.

BACKGROUND

1. Technical Field

The disclosure relates to a controller for an internal combustion engine, an internal combustion engine, and a control method of an internal combustion engine.

2. Description of Related Art

Japanese Unexamined Patent Application Publication No. 2003-106235 (JP 2003-106235 A) discloses a controller for an internal combustion engine in which fuel supplied from a common rail is further pressurized by a pressure intensifier and is injected by a fuel injector and the controller is configured to control a fuel injection pressure by controlling a fuel pressure in the common rail.

SUMMARY

Such a pressure intensifier includes a housing and a piston which is disposed in the housing, and the piston moves in the housing to intensify a pressure of fuel by pushing out fuel, which is supplied to a pressure intensification chamber formed in the housing from the common rail, from the pressure intensification chamber.

In order to control driving of such a piston, a pressure intensification control chamber in addition to the pressure intensification chamber is formed in the housing of the pressure intensifier. The pressure intensification control chamber can be selectively connected to the common rail and a fuel tank, and fuel in the common rail can be supplied to the pressure intensification control chamber when the pressure intensification control chamber is connected to the common rail. Movement of the piston is restricted by fuel supplied from the common rail to the pressure intensification control chamber. On the other hand, when the pressure intensification control chamber is connected to the fuel tank, fuel in the pressure intensification control chamber is discharged to the fuel tank. Accordingly, the pressure of the pressure intensification control chamber decreases to release restriction of movement of the piston and the piston moves in the housing. As a result, fuel in the pressure intensification chamber is pushed out of the pressure intensification chamber and pressure intensification of fuel is carried out at that time. The pressure of the pressure-intensified fuel is proportional to the pressure of fuel supplied to the pressure intensifier. Accordingly, the pressure of fuel supplied to the pressure intensifier is controlled such that the fuel pressure of the pressure-intensified fuel is controlled.

When the state in which the pressure intensification control chamber is connected to the common rail is switched to the state in which the pressure intensification control chamber is connected to the fuel tank in order to drive the pressure intensifier, the common rail is connected to the fuel tank during the switching operation as a result, a fuel pressure of the common rail decreases and a fuel pressure of fuel which is discharged from the pressure intensifier, that is, a fuel injection pressure, also decreases. There is a problem in that control accuracy of the fuel injection pressure decreases due to a decrease in fuel injection pressure based on the driving of the pressure intensifier.

A first aspect of the disclosure provides a controller for an internal combustion engine. The internal combustion engine includes; a fuel tank; a supply pump configured to increase a pressure of fuel that is supplied from the fuel tank; a high-pressure fuel passage configured to allow the fuel of which the pressure has been increased by the supply pump to flow; a pressure intensifier configured to intensify the pressure of fuel supplied from the high-pressure fuel passage; a low-pressure fuel passage configured to allow fuel, that is not pressure-intensified by the pressure intensifier and returned to the fuel tank, to low in order to drive the pressure intensifier; a switching device disposed M the pressure intensifier and configured to switch a state in which the pressure intensifier is connected to the high-pressure fuel passage to a state in which the pressure intensifier is connected to the fuel tank in order to intensify the pressure of fuel; a fuel injector configured to inject fuel of which the pressure has been intensified by the pressure intensifier; and an electronic control unit. The electronic control unit is configured to set a target fuel pressure that is a target value of the pressure of fuel supplied to the high-pressure fuel passage based on a target injection pressure that is a target value of the pressure of fuel supplied to the fuel injector. The electronic control unit is configured to control the supply pump such that the pressure of fuel in the high-pressure fuel passage reaches the target fuel pressure and then to drive the pressure intensifier. The electronic control unit is configured to set the target fuel pressure to be higher as a fuel leakage volume becomes larger during a predetermined period of time when the pressure of fuel is intensified by the pressure intensifier. The predetermined period of time is a period of time until the switching device switches the state in which the pressure intensifier is connected to the high-pressure fuel passage to the state in which the pressure intensifier is connected to the fuel tank. The fuel leakage volume is a volume of fuel that leaks from the high-pressure fuel passage to the fuel tank via the switching device.

With this configuration, since the fuel pressure of the common rail (the high-pressure fuel passage) can be controlled in consideration of a decrease in fuel pressure of the common rail (the high-pressure fuel passage) based on driving of the pressure intensifier, it is possible to enhance control accuracy of a fuel injection pressure.

In the controller for the internal combustion engine, the electronic control unit may be configured to set a temporary target fuel pressure that is the target value of a fuel pressure in the high-pressure fuel passage based on the target injection pressure on the premise that the fuel leakage volume is not considered and may be configured to set the target fuel pressure to be higher by correcting the temporary target fuel pressure such that the temporary target fuel pressure increases as the fuel leakage volume becomes larger.

In the controller for the internal combustion engine, the electronic control unit may be configured to set the target fuel pressure to be higher as a bulk modulus of elasticity of fuel supplied to the internal combustion engine becomes larger when the pressure of fuel is intensified by the pressure intensifier.

In the controller for the internal combustion engine, the electronic control unit may be configured to store a map of the bulk modulus of elasticity in which the bulk modulus of elasticity corresponding to at least one of a temperature of fuel in the high-pressure fuel passage and the pressure or fuel in the nigh-pressure fuel passage is stored and to calculate the bulk modulus of elasticity of the fuel based on the map of the bulk modulus of elasticity. The electronic control unit may be configured to update the map of the bulk modulus of elasticity when fuel is supplied to the fuel tank.

In the controller for the internal combustion engine, the electronic control unit may be configured to store a map of the fuel leakage volume in which the fuel leakage volume corresponding to at least one of a temperature of fuel in the high-pressure fuel passage and the pressure of fuel in the high-pressure fuel passage is stored and to calculate the fuel leakage volume based on the map of the fuel leakage volume. The electronic control unit may be configured to update the map of the fuel leakage volume when fuel is supplied to the fuel tank.

A second aspect of the disclosure provides an internal combustion engine. The internal combustion engine includes: a fuel tank; a supply pump configured to increase a pressure of fuel that is supplied from the fuel tank; a high-pressure fuel passage configured to allow the fuel of which the pressure has been increased by the supply pump to flow; a pressure it configured to intensify the pressure of fuel supplied from the high-pressure fuel passage; a low-pressure fuel passage configured to allow fuel, that is not intensified by the pressure intensifier and returned to the fuel tank, to flow in order to drive the pressure intensifier; a switching device disposed in the pressure intensifier and configured to switch a state in which the pressure intensifier is connected to the high-pressure fuel passage to a state in which the pressure intensifier is connected to the fuel tank in order to intensify fuel; a fuel injector configured to inject fuel of which the pressure has been intensified by the pressure intensifier; and an electronic control unit. The electronic control unit is configured to set a target fuel pressure that is a target value of the pressure of fuel supplied to the high-pressure fuel passage based on a target injection pressure that is a target value of the pressure of fuel supplied to the fuel injector. The electronic control unit is configured to control the supply pump such that the pressure of fuel in the high-pressure fuel passage reaches the target fuel pressure and then to drive the pressure intensifier. The electronic control unit is configured to set the target fuel pressure to be higher as a fuel leakage volume becomes larger during a predetermined period of time when the pressure of fuel is intensified by the pressure intensifier. The predetermined period of time is a period of time until the switching device switches the state in which the pressure intensifier is connected to the high-pressure fuel passage to the state in which the pressure intensifier is connected to the fuel tank. The fuel leakage volume is a volume of fuel that leaks from the high-pressure fuel passage to the fuel tank via the switching device.

With this configuration, since the fuel pressure of the common rail (the high-pressure fuel passage) can be controlled in consideration of a decrease in fuel pressure of the common rail (the high-pressure fuel passage) based on driving of the pressure intensifier, it is possible to enhance control accuracy of a fuel injection pressure.

A third aspect of the disclosure provides a control method of an internal combustion engine. The internal combustion engine includes: a fuel tank; a supply pump configured to increase a pressure of fuel that is supplied from the fuel tank; a high-pressure fuel passage configured to allow the fuel of which the pressure has been increased by the supply pump to flow; a pressure intensifier configured to intensify the pressure of fuel supplied from the high-pressure fuel passage; a low-pressure fuel passage configured to allow fuel, that is not intensified by the pressure intensifier and returned to the fuel tank to flow in order to drive the pressure intensifier; a switching device disposed in the pressure intensifier and configured to switch a state in which the pressure intensifier is connected to the high-pressure fuel passage to a state in which the pressure intensifier is connected to the fuel tank in order to intensify fuel; a fuel injector configured to inject fuel of which the pressure has been intensified by the pressure intensifier; and an electronic control unit. The control method includes: setting, by the electronic control unit, a target fuel pressure that is a target value of the pressure of fuel supplied to the high-pressure fuel passage based on a target injection pressure that is a target value of the pressure of fuel supplied to the fuel injector; controlling, by the electronic control unit, the supply pump such that the pressure of fuel in the high-pressure fuel passage reaches the target fuel pressure and then to drive the pressure intensifier; and setting, by the electronic control unit, the target fuel pressure to be higher as a fuel leakage volume becomes larger during a predetermined period of time when the pressure of fuel is intensified by the pressure intensifier. The predetermined period of time is a period of time until the switching device switches the state in which the pressure intensifier is connected to the high-pressure fuel passage to the state in which the pressure intensifier is connected to the fuel tank. The fuel leakage volume is a volume of fuel that leaks from the high-pressure fuel passage to the fuel tank via the switching device.

With this configuration, since the fuel pressure of the common rail (the high-pressure fuel passage) can be controlled in consideration of a decrease in fuel pressure of the common rail (the high-pressure fuel passage) based on driving of the pressure intensifier, it is possible to enhance control accuracy of a fuel injection pressure.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Hereinafter, embodiments of the disclosure will be described in detail with reference to the accompanying drawings. In the following description, the same elements will be referenced by the same reference signs.

Figure 1:
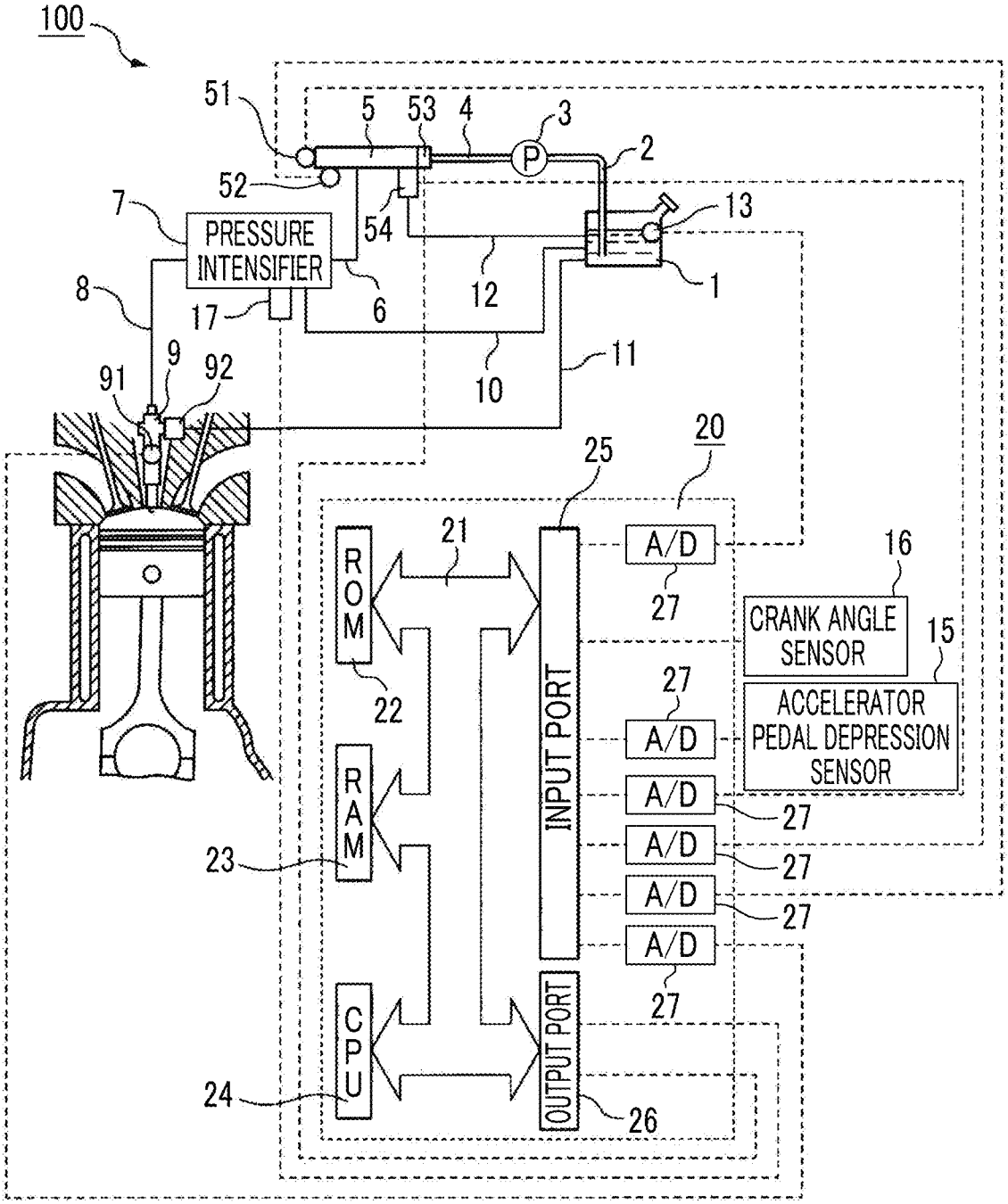
FIG. 1 is a diagram schematically illustrating an internal combustion engine according to a first embodiment of the disclosure.

FIG. 1 is a diagram schematically illustrating an internal combustion engine 100 according to a first embodiment of the disclosure and an electronic control unit 20 that controls the internal combustion engine 100. The internal combustion engine 100 according to the disclosure includes a fuel tank 1, a pump suction passage 2, a supply pump 3, a pump discharge passage 4, a common rail 5, a supply passage 6, a pressure intensifier 7, an injection passage 8, an injector 9, a return passage 10, a relief passage 11, and a decompression passage 12.

The fuel tank 1 stores fuel supplied from outside under atmospheric pressure. The fuel stored in the fuel tank 1 is suctioned via the pump suction passage 2 by the supply pump 3. A fuel level sensor 13 that detects an amount of fuel stored in the fuel tank 1 is provided in the fuel tank 1.

The supply pump 3 suctions fuel stored in the fuel tank 1 and increases the pressure thereof. The fuel increased in pressure by the supply pump 3 is supplied to the common rail 5 via the pump discharge passage 4. An amount of fuel discharged from the supply pump 3 can be controlled, and thus the pressure of fuel in the common rail 5 can be controlled by increasing the amount of fad discharged from the supply pump 3.

The common rail 5 maintains the fuel supplied via the pump discharge passage 4 from the supply pump 3 at a high pressure. The common rail 5 is connected to a plurality of supply passages 6 corresponding to cylinders and supplies the fuel to the cylinders.

A common rail pressure sensor 51 that measures a pressure of fuel maintained in the common rail 5 is provided in the common rail 5. The pressure measured by the common rail pressure sensor 51 is referred to as a measured value Pcr_s of a common rail pressure. A common rail temperature sensor 52 that measures a temperature of fuel maintained in the common rail 5 is provided in the common rail 5. The temperature measured by the common rail temperature sensor 52 is referred to as a common rail temperature Tcr. A heater 53 is provided in the common rail 5 to adjust the temperature of fuel in the common rail 5. The temperature of the heater 53 is adjusted by the electronic control unit 20 which will be described later.

In order to decrease the pressure of fuel maintained in the common rail 5, a part of fuel supplied to the common rail 5 is discharged to the fuel tank 1 via the decompression passage 12. An amount of fuel discharged from the common rail 5 to the fuel tank 1 is controlled by a decompression valve 54 which is provided between the common rail 5 and the decompression passage 12. Opening and closing of the decompression valve 54 is controlled by the electronic control unit 20 which will be described later.

The pressure intensifier 7 is provided to correspond to the cylinders, further intensifies the pressure of fuel supplied from the common rail 5 via the supply passage 6, and supplies the pressure-intensified fuel to the injector 9 via the injection passage 8. When the pressure of fuel is intensified by the pressure intensifier 7, an actuator 17 provided in the pressure intensifier 7 switches a state in which the pressure intensifier 7 is connected to the common rail 5 to a state in which the pressure intensifier 7 is connected to the fuel tank 1 via the return passage 10. At this time, the pressure intensifier 7 supplies the pressure-intensified fuel to the injector 9 via the injection passage 8, and the pressure intensifier 7 discharges fuel for controlling the pressure intensifier 7 to the fuel tank 1 via the return passage 10.

The injector 9 is provided to correspond to the cylinders and injects fuel supplied from the pressure intensifier 7 via the injection passage 8 to the corresponding cylinder. An amount of fuel injected into the corresponding cylinder (an amount of injected fuel) increases as the pressure of fuel supplied to the injector 9 increases when a valve-opening time of the injector 9 is constant. Accordingly, in this embodiment, the pressure of fuel supplied to the injector 9 is controlled to control the amount of injected fuel. Accordingly, an injection pressure sensor 91 that measures a pressure of fuel supplied to the injector 9 is provided in the injector 9.

A relief valve 92 that is used to return fuel to the fuel tank 1 via the relief passage 11 when the pressure of fuel increases excessively is provided in the injector 9. The relief valve 92 is provided between the inside of the injector 9 and the relief passage 11, and is opened when the pressure of fuel in the injector 9 is higher than a predetermined pressure of fuel such that the fuel inside the injector 9 is discharged to the fuel tank 1.

The electronic control unit 20 controls the pressure of fuel in the common rail 5, intensification of the pressure of fuel by the pressure intensifier 7, and injection of fuel from the injector 9. The electronic control unit 20 is constituted by a digital computer and includes a ROM 22, a RAM 23, a CPU 24, an input port 25, an output port 26, and an AD converter 27 which are connected to each other via a bidirectional bus 21.

Analog signals from the fuel level sensor 13, the common rail pressure sensor 51, the common rail temperature sensor 52, and the injection pressure sensor 91 are converted into digital signals by the corresponding AD converter 27 and are then input to the input port 25. In order to detect a load on the internal combustion engine 100, an analog signal from an accelerator pedal depression sensor 15 that detects an amount of depression of an accelerator pedal is converted into a digital signal by the AD converter 27 and is the input to the input port 25. A digital signal output from a crank angle sensor 16 that detects a rotation speed of a crank shaft is input to the input port 25. In this way, output signals of various sensors required for controlling the internal combustion engine 100 are input to the input port 25. The output port 26 is connected to the supply pump 3, the pressure intensifier 7, the injector 9, and the like and outputs digital signals calculated by the CPU 24.

Figure 2A:
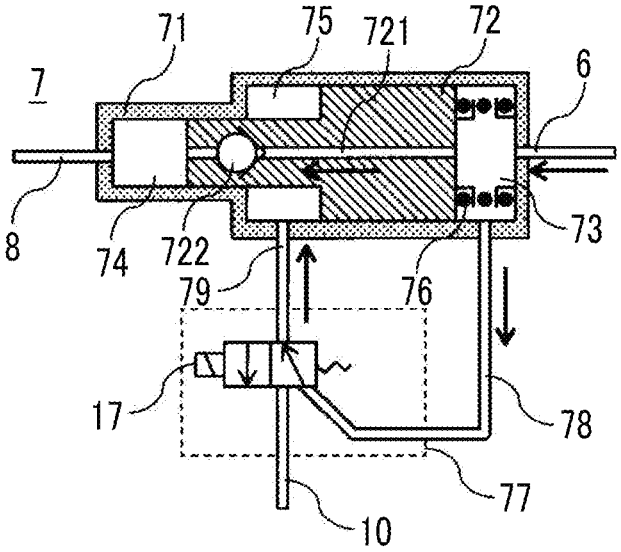
FIG. 2A is a diagram schematically illustrating a state of a pressure intensifier before pressure intensification is performed.
Figure 2B:
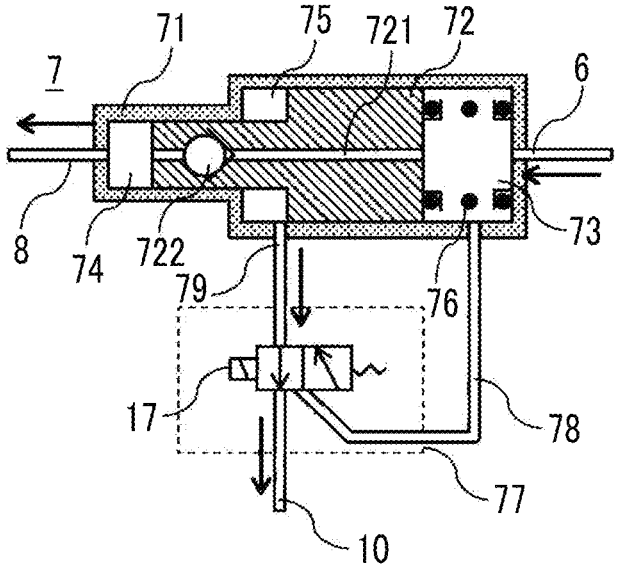
FIG. 2B is a diagram schematically illustrating a state of the pressure intensifier after pressure intensification is performed.

The configuration of the pressure intensifier 7 will be described below with reference to FIGS. 2A and 2B. FIG. 2A is a diagram schematically illustrating a state of the pressure intensifier 7 before a pressure of fuel is intensified by the pressure intensifier 7. FIG. 2B is a diagram schematically illustrating a state in which fuel is pressure-intensified and is then discharged to the injector 9 by the pressure intensifier 7.

As illustrated in FIG. 2A, the pressure intensifier 7 includes a housing 71, a piston 72, a piston chamber 73, a pressure intensification chamber 74, a pressure intensification control chamber 75, a spring 76, a three-way valve 77, a first three-way valve passage 78, and a second three-way valve passage 79. Arrows in FIGS. 2A and 2B denote a direction in which fuel flows.

The inside of the housing 71 is filled with fuel. In this embodiment, the supply passage 6 is connected to one end in a length direction (the right end in the drawings) of the housing 71, the injection passage 6 is connected to the other end (the left end in the drawings), and fuel supplied to the housing 71 via the supply passage 6 is discharged from the injection passage 8. In the following description, the right side in FIGS. 2A and 2B is referred to as the supply passage 6 side, and the left side in FIGS. 2A and 2B is referred to as the injection passage 8 side. The housing 71 has a shape in which two cylinders having different inner diameters are joined together, and the inner diameter of the cylinder on the supply passage 6 side is larger than the inner diameter of the cylinder on the injection passage 8 side. In the following description, the cylinder on the supply passage 6 side is referred to as a "large-diameter portion of the housing 71," the inner circumferential surface of the large-diameter portion of the housing 71 is referred to as a "large-diameter inner circumferential surface of the housing 71," the cylinder on the injection passage 8 side is referred to as a "small-diameter portion of the housing 71," and the inner circumferential surface of the small-diameter portion of the housing 71 is referred to as a "small-diameter inner circumferential surface of the housing 71."

The piston 72 is accommodated in the housing 71 such that the piston 72 is movable in the housing 71 in the length direction of the housing 71.

The piston 72 has a shape in which two columns having different diameters are joined together and the diameter on the supply passage 6 side is larger than the diameter on the injection passage 8 side. In the following description, the column on the supply passage 6 side is referred to as a "large-diameter portion of the piston 72," the outer circumferential surface of the large-diameter portion of the piston 72 is referred to as a "large-diameter outer circumferential surface of the piston 72," the column on the injection passage 8 side is referred to as a "small-diameter portion of the piston 72," and the outer circumferential surface of the small-diameter portion of the piston 72 is referred to as a "small-diameter outer circumferential surface of the piston 72."

By, the piston 72 and the housing 71, a piston chamber 73 that is disposed on the supply passage 6 side, a pressure intensification chamber 74 that is disposed on the injection passage 8 side, and a pressure intensification control chamber 75 that is disposed between the piston chamber 73 and the pressure intensification chamber 74 are formed in the housing 71.

The piston 72 includes a piston-inside passage 721 that is disposed to penetrate the piston 72 in the length direction thereof and a check valve 722 that is disposed in the piston-inside passage 721. The check valve 722 permits fuel to flow in the piston-inside passage 721 from the piston chamber 73 to the pressure intensification chamber 74 and prohibits fuel to flow in the piston-inside passage 721 from the pressure intensification chamber 74 to the piston chamber 73.

The piston chamber 73 is a space which is formed by an end surface of the large-diameter portion of the housing 71, the large-diameter inner circumferential surface of the housing 71, and an end surface of the large-diameter portion of the piston 72. The piston chamber 73 is supplied with high-pressure fuel from the common rail 5 via the supply passage 6 and is filled with the high-pressure fuel. A spring 76 is provided in the piston chamber 73 such that a tension for normally pulling the piston 72 toward the supply passage 6 is generated.

The pressure intensification chamber 74 is a space which is formed by the small-diameter inner circumferential surface of the housing 71, an end surface of the small-diameter portion of the housing 71, and an end surface of the small-diameter portion of the piston 72. The pressure intensification chamber 74 is connected to the piston chamber 73 via the piston-inside passage 721, and the pressure intensification chamber 74 is supplied with fuel in the piston chamber 73. The pressure intensification chamber 74 is also connected to the injection passage 8.

The pressure intensification control chamber 75 is disposed between the piston chamber 73 and the pressure intensification chamber 74, and is a space which is defined by the large-diameter inner circumferential surface of the housing 71 and the small-diameter outer circumferential surface of the piston 72.

The pressure intensification control chamber 75 is selectively connected to the common rail 5 and the fuel tank 1. Here, the pressure intensification control chamber 75 and the common rail 5 do not need to be connected directly to each other, and a state in which fuel in the common rail 5 can be supplied to the pressure intensification control chamber 75 has only to be formed. Similarly, the pressure intensification control chamber 75 and the fuel tank 1 do not need to be connected directly to each other, and a state in which fuel in the pressure intensification control chamber 75 can be discharged to the fuel tank 1 has only to be formed. In this embodiment, the pressure intensification control chamber 75 is connected to the common rail 5 via the second three-way valve passage 79, the first three-way valve passage 78, the piston chamber 73, and the supply passage 6, and the pressure intensification control chamber 75 is connected to the fuel tank 1 via the second three-way valve passage 79 and the return passage 10.

When the pressure intensification control chamber 75 is connected to the common rail 5 as illustrated in FIG. 2A, high-pressure fuel from the common rail 5 is supplied to the pressure intensification control chamber 75. On the other hand, when the pressure intensification control chamber 75 is connected to the fuel tank 1 as illustrated in FIG. 2B, fuel in the pressure intensification control chamber 75 is discharged to the fuel tank 1 and the fuel pressure in the pressure intensification control chamber 75 decreases.

The three-way valve 77 is a spool type electromagnetic valve in this embodiment. By driving the three-way valve 77 using an actuator 17 which is provided in the three-way valve 77, the pressure intensifier 7 can be switched between a state (FIG. 2A) in which the pressure intensification control chamber 75 is connected to the common rail 5 and a state (FIG. 2B) in which the pressure intensification control chamber 75 is connected to the fuel tank 1. The actuator 17 is controlled using a signal output from the electronic control unit 20.

Figure 3A:
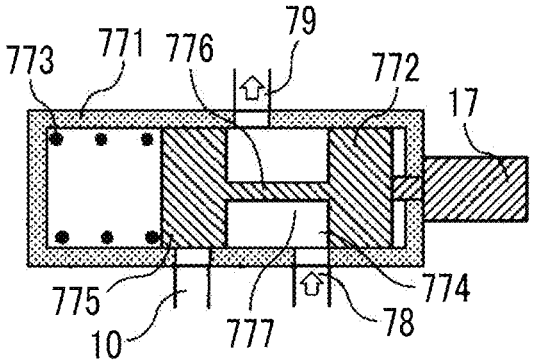
FIG. 3A is a diagram schematically illustrating a structure of a three-way valve before pressure intensification is performed.

The three-way valve 77 will be described below with, reference to FIG. 3A. FIG. 3A is a diagram schematically illustrating a structure of the three-way valve 77 before pressure intensification is carried out. The three-way valve 77 includes a three-way valve housing 771, a three-way valve spool 772, a three-way valve spring 773, and an actuator 17.

The three-way valve housing 771 has a cylindrical shape, and a space is formed in the three-way valve housing 771. The inside of the three-way valve housing 771 is connected to the first three-way valve passage 78, the second three-way valve passage 79, and the return passage 10. The actuator 17 that drives the three-way valve spool 772 is provided at one end in the length direction of the three-way valve housing 771.

The three-way valve spool 772 is accommodated in the three-way valve housing 771, and can reciprocate in the length direction of the three-way valve housing 771. The three-way valve spool 772 defines a space in the three-way valve housing 771, and includes a first sealing portion 774 and a second sealing portion 775 that prohibit flowing of fuel and a connecting portion 776 that integrally connect the first sealing portion 774 and the second sealing portion 775. In the following description, a space surrounded by the inner circumferential surface of the three-way valve housing 771, an end surface of the first sealing portion 774, and an end surface of the second sealing portion 775 is referred to as a fuel chamber 777. The three-way valve spring 773 is accommodated between the second sealing portion 775 and an end surface of the inner circumferential surface of the three-way valve housing 771, and the three-way valve spring 773 presses the three-way valve spool 772 to the right side in FIG. 3A.

Figure 3B:
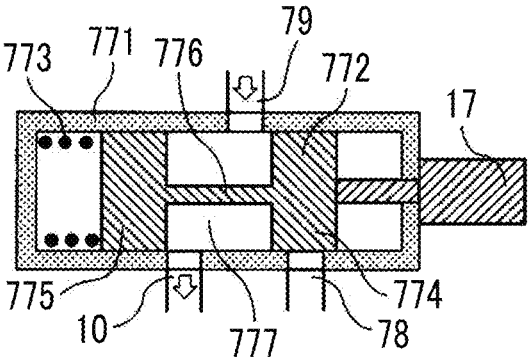
FIG. 3B is a diagram schematically illustrating a structure of the three-way valve when pressure intensification is being preformed.

An operation of the three-way valve 77 will be described below with reference to FIGS. 3A and 3B. FIG. 3A is a diagram schematically illustrating the structure of the three-way valve 77 before pressure intensification is carried out, and FIG. 3B is a diagram schematically illustrating the structure of the three-way valve 77 when pressure intensification is being carried out.

When the actuator 17 receives a signal from the electronic control unit 20 and is turned on, the actuator 17 applies a force to the left side in the drawings to the three-way valve spool 772. Then, as illustrated in FIG. 3B, the three-way valve spool 772 is disposed on the left side in the drawing. On the other hand, when the actuator 17 is turned off, the three-way valve spool 772 receives a force from the three-way valve spring 773 and the three-way valve spool 772 is disposed on the right side in the drawing as illustrated in FIG. 3A. In this way, the position of the three-way valve spool 772 is determined based on a signal which the actuator 17 receives from the electronic control unit 20.

A passage that connects the fuel chamber 777 to the first three-way valve passage 78, a passage that connects the fuel chamber 777 to the second three-way valve passage 79, and a passage that connects the fuel chamber 777 to the return passage 10 are provided in the three-way valve housing 771.

When the three-way valve spool 772 is located on the right side in the drawing as illustrated in FIG. 3A, the passage that connects the fuel chamber 777 to the return passage 10 is sealed by the three-way valve spool 772. Accordingly, the fuel chamber 777 is supplied with fuel from the first three-way valve passage 78, and fuel supplied to the fuel chamber 777 is discharged to the second three-way valve passage 79. That is, the three-way valve 77 connects the first three-way valve passage 78 to the second three-way valve passage 79.

On the other hand, when the three-way valve spool 772 is located on the left side in the drawing as illustrated in FIG. 3B, the passage that connects the fuel chamber 777 to the first three-way valve passage 78 is sealed by the three-way valve spool 772. Accordingly, the fuel chamber 777 is supplied with fuel from the second three-way valve passage 79, and fuel supplied to the fuel chamber 777 is discharged to the return passage 10. That is, the three-way valve 77 connects the second three-way valve passage 79 to the return passage 10.

Conclusively, by causing the three-way valve spool 772 to move using the actuator 17, the three-way valve 77 is switched between the state in which the pressure intensification control chamber 75 is connected to the common rail 5 and the state in which the pressure intensification control chamber 75 is connected to the fuel tank 1.

Figure 4A:
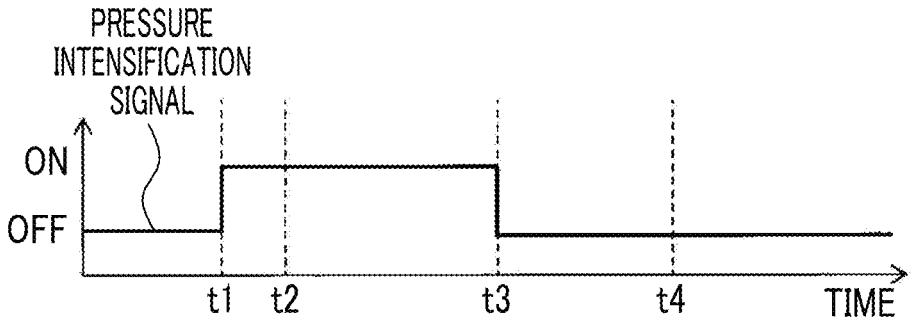
FIG. 4A is a diagram illustrating a change over time of a signal which is transmitted from an electronic control unit to the pressure intensifier.
Figure 4B:
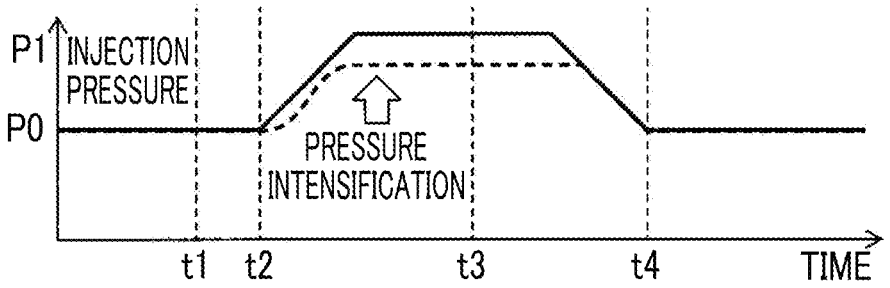
FIG. 4B is a diagram illustrating a change over time of a pressure of fuel which is discharged from the pressure intensifier to an injector.

An operation of the pressure intensifier 7 will be described below with reference to FIGS. 2A to 4B. FIG. 4A is a timing chart illustrating a change over time of a signal which is transmitted from the electronic control unit 20 to the pressure intensifier 7, and FIG. 4B is a timing chart illustrating a change over time of a pressure of fuel which is discharged from the pressure intensifier 7 to the injector 9.

First, in an initial state (a state before time t1), the three-way valve 77 connects the common rail 5 to the pressure intensification control chamber 75 as illustrated in FIGS. 2A and 3A. At this time, the piston chamber 73 and the pressure intensification control chamber 75 are supplied with high-pressure fuel from the common rail 5. Accordingly, the fuel pressures of the piston chamber 73 and the pressure intensification control chamber 75 are balanced. However, since the piston 72 is pulled by the spring 76 which is disposed in the piston chamber 73, the piston 72 is disposed on the supply passage 6 side.

At time t1, the electronic control unit 20 switches a pressure intensification signal which is a signal for driving the pressure intensifier 7 from OFF to ON, and drives the actuator 17. As a result, a force toward the left side in FIG. 3A is applied to the three-way valve spool 772 of the three-way valve 77.

When some time elapses after the pressure intensification signal is switched to ON, the three-way valve 77 is switched from the state illustrated in FIG. 3A to the state illustrated in FIG. 3B. That is, since the pressure intensification control chamber 75 is connected to the fuel tank 1 via the return passage 10, fuel in the pressure intensification control chamber 75 is discharged to the fuel tank 1 and thus the fuel pressure in the pressure intensification control chamber 75 decreases. As a result, since the pressure in the piston chamber 73 is higher than the pressure in the pressure intensification control chamber 75, the fuel filled in the piston chamber 73 applies a force for pressing the piston 72 to the injection passage 8 side and the piston 72 starts movement to the injection passage 8 side. From time t1 to time t2, the piston 72 is located on the supply passage 6 side as illustrated in Ha 2A, and the three-way valve spool 772 is located on the left side in the drawing as illustrated in FIG. 3B.

Subsequently, at time t2, when the piston 72 starts movement to the injection passage 8 side as illustrated in FIG. 2B, the volume of the pressure intensification chamber 74 decreases and fuel filled in the pressure intensification chamber 74 is discharged to the injection passage 8. Here, a sectional area S0 of the large-diameter portion of the piston 72 is larger than a sectional area S1 of the small-diameter portion of the piston 72, a fuel pressure P1 in the pressure intensification chamber 74 is intensified to S0/S1 times a fuel pressure P0 in the piston chamber 73 based on Pascal's principle. In the following description, the fuel pressure ratio S0/S1 is referred to as a pressure intensification ratio $\alpha$. For example, in this embodiment, the pressure intensification ratio $\alpha$ is 2. Since the check valve 722 is provided in the piston-inside passage 721, fuel does not flow back to the piston chamber 73 with the reduction of the pressure intensification chamber 74. From time t2 to time t3, the piston 72 is switched from the state illustrated in FIG. 2A to the state illustrated in FIG. 2B, and the three-way valve spool 772 is located on the left side in the drawing as illustrated in FIG. 3B.

Then, at time t3, the electronic control unit 20 switches the pressure intensification signal from ON to OFF and stops supply of electric power to the actuator 17. As a result, the three-way valve spool 772 of the three-way valve 77 receives a force to the right side in the drawing from the three-way valve spring 773.

When some time elapses after the pressure intensification signal is switched to OFF, the three-way valve 77 is switched from the state illustrated in FIG. 3B to the state illustrated in FIG. 3A. That is, since the pressure intensification control chamber 75 is connected to the common rail 5 via the piston chamber 73, the pressure intensification control chamber 75 is supplied with high-pressure fuel from the common rail 5 and the fuel pressure in the pressure intensification control chamber 75 increases. As a result, the force with which the piston 72 pushes the fuel in the pressure intensification chamber 74 is weakened, and the pressure of fuel discharged from the pressure intensification chamber 74 decreases with the lapse of time. From time t3 to time t4, the pressure intensifier 7 is switched to the state illustrated in FIG. 2B and the three-way valve 77 is switched to the state illustrated in FIG. 3A.

At time t4 at which time has further elapsed, the piston 72 stops movement to the injection passage 8 side and the pressure of fuel discharged from the pressure intensification chamber 74 becomes equal to the pressure of fuel supplied from the common rail 5. When time further elapses, the piston 72 moves to the supply passage 6 side by the tension of the spring 76 and is finally returned to the state illustrated in FIG. 2A. When the piston 72 is moving to the supply passage 6 side after time t4, the volume of the pressure intensification chamber 74 increases and the pressure intensification chamber 74 is supplied with fuel from the piston chamber 73 via the piston-inside passage 721.

As described above, it is possible to increase a fuel injection pressure by driving the pressure intensifier 7, that is, causing the piston 72 to reciprocate, whenever the time for fuel injection arrives.

Setting of the fuel injection pressure will be described below in brief. First, the electronic control unit 20 sets a target fuel injection pressure Pinj_t which is a target value of the pressure of fuel supplied to the injector 9 based on a detected value (an engine load) of the accelerator pedal depression sensor 15. When the fuel pressure is magnified to $\alpha$ times by driving the pressure intensifier 7, the electronic control unit 20 sets a target common rail pressure Pcr_t which is a target pressure of the common rail 5 to Pinj_t/$\alpha$.

When fuel injection is performed, the electronic control unit 20 controls the fuel pressure of the common rail 5 with Pinj_t/$\alpha$ by controlling an amount of fuel supplied from the supply pump 3. The fuel of the common rail 5 is supplied to the piston chamber 73. Then, by driving the pressure intensifier 7, the fuel in the piston chamber 73 pushes the piston 72 to the injection passage 8 side and the pressure of fuel supplied to the injector 9 becomes the target fuel injection pressure Pinj_t.

When the pressure intensifier 7 is driven, it was found that a measured value Pinj_s of the fuel injection pressure which is a pressure of fuel acquired from an injection pressure sensor 91 which is disposed in the injector 9 becomes smaller than the target fuel injection pressure Pinj_t and the measured value Pinj_s of the fuel injection pressure exhibits a change over time indicated by a dotted line in FIG. 4B.

The reason why the measured value Pinj_s of the fuel injection pressure becomes smaller than the target fuel injection pressure Pinj_t is thought that the pressure of the common rail 5 decreases due to leakage of fuel in the common rail 5 to the fuel tank 1 while the three-way valve 77 is being switched from the state illustrated in FIG. 3A to the state illustrated in FIG. 3B.

Figure 5:
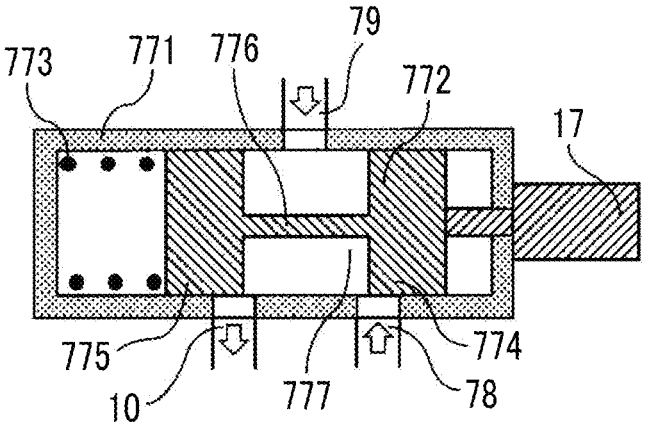
FIG. 5 is a diagram schematically illustrating a state of the pressure intensifier when the state illustrated in FIG. 3A is being switched to the state illustrated in FIG. 3B.

FIG. 5 is a diagram schematically illustrating an intermediate state until the three-way valve 77 is switched from the state illustrated in FIG. 3A to the state illustrated in FIG. 3B. While the three-way valve spool 772 is moving as illustrated in FIG. 5, the fuel chamber 777 is in a state in which the fuel chamber 777 is connected to all of the return passage 10, the first three-way valve passage 78, and the second three-way valve passage 79, that is, a state in which the three-way valve 77 connects the common rail 5 to the fuel tank 1. When the common rail 5 is connected to the fuel tank 1, fuel in the common rail 5 is discharged to the fuel tank 1 and thus the fuel in the common rail 5 increases and the pressure of fuel decreases. When the pressure in the common rail 5 decreases, it means that the pressure in the piston chamber 73 decreases. As described above, since the pressure intensification ratio $\alpha$ of the pressure in the piston chamber 73 is a pressure of fuel supplied to the injector 9, the pressure of fuel supplied to the injector 9 also decreases due to the decrease in pressure in the piston chamber 73.

Discharge of fuel in the common rail 5 to the fuel tank 1 by connecting the common rail 5 to the fuel tank 1 is hereinafter referred to as leakage of fuel and a volume of fuel discharged to the fuel tank 1 due to the leakage of fuel is referred to as a fuel leakage volume $\Delta$Vl.

Figure 6:
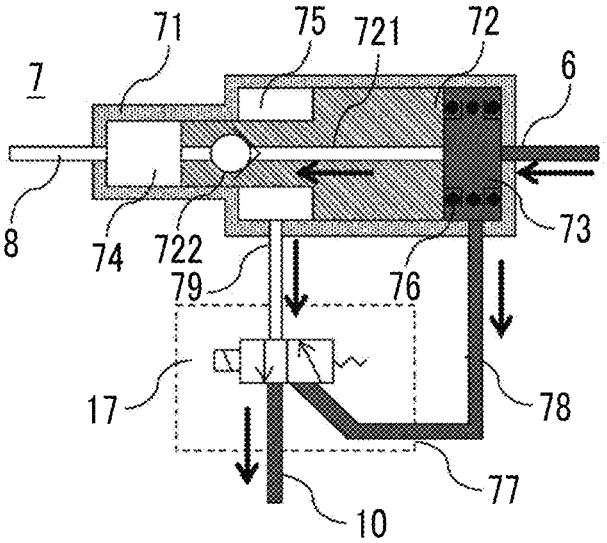
FIG. 6 is a diagram schematically illustrating a state in which fuel leaks when the three-way valve is in the state illustrated in FIG. 5.

FIG. 6 is a diagram schematically illustrating a state in which fuel leaks when the three-way valve 77 is in the state illustrated in FIG. 5. A volume of fuel discharged from the common rail 5 to the fuel tank 1 via the supply passage 6, the piston chamber 73, the first three-way valve passage 78, and the return passage 10 is the fuel leakage volume $\Delta$Vl (see a colored path in FIG. 6).

In general, when a variation of the pressure of fuel is defined as ΔP, a volume before the volume of fuel increases is defined as V0, an increase of the volume of fuel is defined as ΔV, and a coefficient is defined as K, a relationship $\Delta P=-K\times\Delta V/V0$ is established. Here, the coefficient K is referred to as a bulk modulus of elasticity K. It is defined that ΔP has a positive value when the pressure increases. ΔV has a positive value when the volume increases, and K has a positive value.

In this embodiment, the pressure ΔP in the above-mentioned equation is a variation in the fuel pressure ΔPs of the common rail 5 (hereinafter referred to as a "common rail pressure variation"). The volume V0 before the volume of fuel increases is a volume of fuel which is maintained at the same pressure as the pressure in the common rail 5 before the pressure intensifier 7 is driven. The volume fuel which is maintained at the same pressure as the pressure in the common rail 5 in this embodiment is a total volume of the pump discharge passage 4, the common rail 5, and the supply passage 6, the piston chamber 73, the first three-way: valve passage 78, the fuel chamber 777, the second three-way valve passage 79, and the pressure intensification control chamber 75 of each cylinder and is referred to as a common rail pressure fuel volume Vs. The increase in the volume of fuel ΔV in this embodiment is a fuel leakage volume ΔVl of fuel discharged from the common rail 5 to the fuel tank 1 at the time of leakage of fuel. In this embodiment, the electronic control unit 20 stores the fuel leakage volume ΔVl corresponding to the pressure and the temperature of the common rail 5 before the pressure intensifier 7 is driven as a map. The electronic control unit 20 calculates the common rail pressure variation ΔPs at the time of driving of the pressure intensifier 7 based on the fuel leakage volume ΔVl which is acquired with reference to the map of the fuel leakage volume ΔVl, in tins embodiment, by setting the target common rail pressure Pcr_t ter Pinj_t/α-ΔPs, it is possible to cause the measured value of the fuel injection pressure Pinj_s to approach the target fuel injection pressure Pinj_t and to enhance control accuracy.

Since the pressure of the common rail 5 decreases with the leakage of fuel, the common rail pressure variation ΔPs has a negative value. Subtraction of the common rail pressure variation ΔPs from the target common, rail pressure Pcr_t refers to an increase of the target common rail pressure Pcr_t.

That is, in this embodiment, the electronic control unit 20 sets the target fuel injection pressure Pinj_t and the target common rail pressure Pct_t depending on the load of the internal combustion engine 100, and corrects the target common rail pressure Pcr_t to increase in consideration of the fuel pressure of the common rail which has decreased due to the leakage of fuel.

In this embodiment, the electronic control unit 20 corrects the target common rail pressure Pcr_t to increase, but may correct the target fuel injection pressure Pinj_t to increase based on the fuel injection pressure which decreases due to the leakage of fuel. In this case, the electronic control unit 20 corrects the target fuel in pressure Pinj_t to increase by the pressure intensification ratio α of the common mil pressure variation ΔPs which decreases due to the leakage of fuel. Even when the target fuel injection pressure Pinj_t is corrected to increase in this way, the target common rail pressure Pcr_t higher than the target common rail pressure Pcr_t before the target fuel injection pressure Pinj_t is corrected to increase is set.

Figure 7:
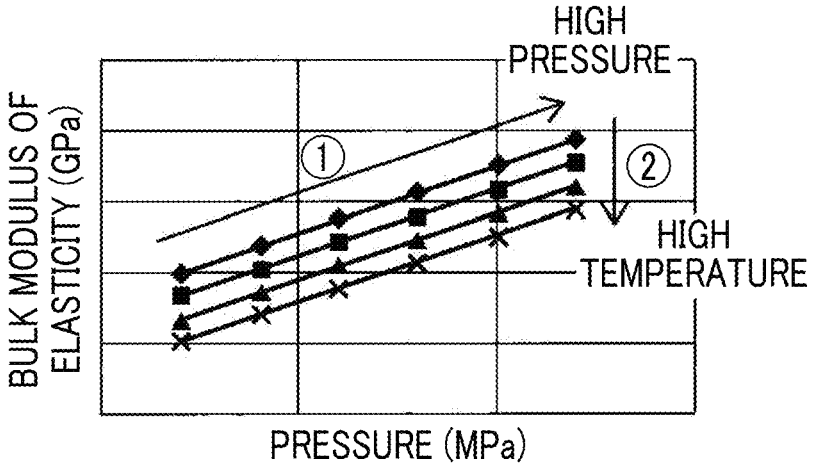
FIG. 7 is a graph illustrating a relationship between a bulk modulus of elasticity, a pressure of fuel in a common rail, and a temperature in the common rail.

The value of the bulk modulus of elasticity K varies depending on the pressure and the temperature of fuel. FIG. 7 is a graph illustrating a relationship between the bulk modulus of elasticity K and the pressure and temperature. As illustrated in FIG. 7, the bulk modulus of elasticity K increases as the pressure of fuel increases, and the bulk modulus of elasticity K decreases as the temperature of fuel increases. In this embodiment, the electronic control unit 20 stores a map of the bulk modulus of elasticity K with respect to the pressure and temperature of fuel, and reads the bulk modulus of elasticity K whenever the electronic control unit 20 calculates the common rail pressure variation ΔPs.

Control according to the first embodiment of the disclosure will be described below. The control according to the first embodiment of the disclosure includes an injection control routine for controlling injection of fuel, a fuel injection setting routine for setting the operations of the supply pump 3, the pressure intensifier 7, and the injector 9, and a target common rail pressure setting routine for setting the target common rail pressure Pcr_t when the pressure intensifier 7 is driven by causing the electronic control unit 20 to control the supply pump 3, the pressure intensifier 7, and the injector 9.

In this embodiment, the electronic control unit 20 outputs signals to the supply pump 3, the pressure intensifier 7, and the injector on the condition that a preset crank angle tea is reached. As a result, the electronic control unit 20 controls the supply pump 3, the pressure intensifier 7, and the injector such that fuel is injected. In this embodiment, the electronic control unit 20 performs the injection control routine in parallel with the fuel injection setting routine. By the fuel injection setting routine, the electronic control unit 20 sets the operations of the supply pump 3, the pressure intensifier 7, and the injector 9 in next fuel injection on the condition that an injection request is issued. When it is determined that it is necessary to drive the pressure intensifier 7 by the fuel injection setting routine, the electronic control unit 20 sets the target common rail pressure Pcr_t by performing the target common rail pressure setting routine.

Figure 8:
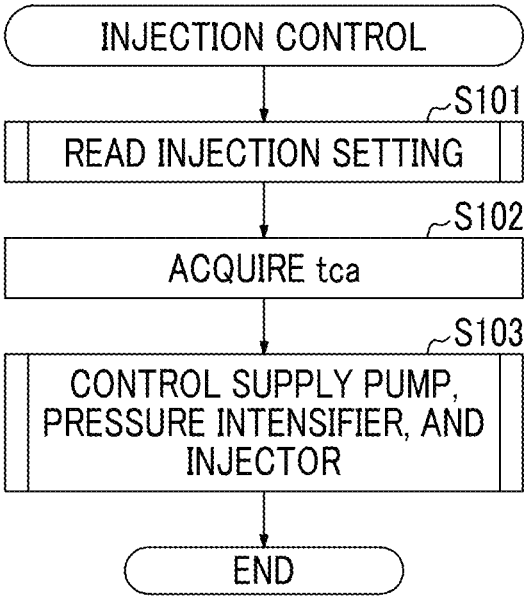
FIG. 8 is a diagram illustrating an injection control routine according to the first embodiment.

FIG. 8 is a flowchart illustrating the injection control routine according to the first embodiment of the disclosure. The electronic control unit 20 repeatedly performs this routine at predetermined intervals.

In Step S101, the electronic control unit 20 reads setting information on fuel injection. That is, setting items of the fuel injection such as the target common rail pressure Pcr_t, the time at which the pressure intensifier 7 is driven, and the time at which the injector 9 is driven are stored in the electronic control unit 20, and the electronic control unit 20 reads the setting items of the fuel injection. The setting items of the fuel injection are determined by the fuel injection setting routine which will be described later.

In Step S102, the electronic control unit 20 acquires a crank angle tea using the crank angle sensor 16.

In Step S103, the electronic control unit 20 controls the supply pump 3, the pressure intensifier 7, and the injector 9 based on the setting items of the fuel injection read in S101 and the crank angle tea read in S102. For example, the electronic control unit 20 outputs a signal to the supply pump 3 such that the measured value Pcr_s of the common rail pressure acquired from the common rail pressure sensor 51 approaches the target common rail pressure Pcr_t read in S101. Alternatively, when the crank angle tea read in S102 becomes the time (for example, t1 in FIG. 4) at which the pressure intensifier 7 is driven which is read in S101 and die measured value Pcr_s of the common rail pressure sufficiently approaches the target common rail pressure Pcr_t, the electronic control unit 20 outputs a pressure intensification signal to the pressure intensifier 7. That is, the pressure intensification signal is switched from OFF to ON. Similarly, when the crank angle tea becomes the time at which the fuel injection is performed by the injector 9, the electronic control unit 20 outputs a signal for injection of fuel to the injector 9 to inject fuel.

As described above, in this embodiment, the electronic control unit 20 controls the supply pump 3 such that the measured value Pcr_s of the common rail pressure reaches the target common rail pressure Pcr_t in S103. Then, the electronic control unit 20 controls the pressure intensifier 7 after controlling the supply pump 3.

Figure 9:
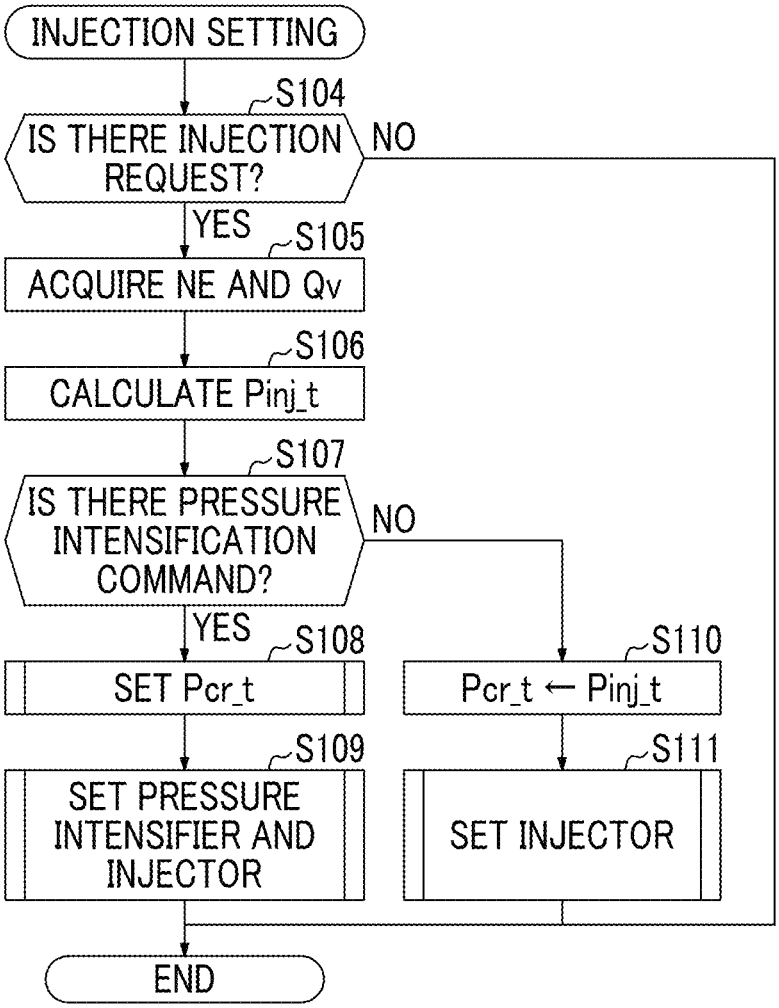
FIG. 9 is a diagram illustrating an injection setting routine according to the first embodiment.

FIG. 9 is a flowchart illustrating the fuel injection setting routine according to the first embodiment. The electronic control unit 20 repeatedly performs this routine at predetermined intervals. In this embodiment, the electronic control unit 20 performs the fuel injection setting routine in parallel with the injection control routine. When new setting items of the fuel injection are set by the fuel injection setting routine while the electronic control unit 20 causes fuel to be injected through the injection control routine, it does not immediately affect the injection of fuel. For example, the newly set setting items of the fuel injection are read at the time of the next injection of fuel.

In Step S104, the electronic control unit 20 determines whether there is a fuel injection request. When it can be determined that the internal combustion engine 100 needs to generate a torque based on the output value of the accelerator pedal depression sensor 15, the electronic control unit 20 determines that it is necessary to perform the injection of fuel, that is, that there is an injection request. When the engine rotation speed NE acquired from the crank angle sensor 16 decreases while the internal combustion engine 100 is operating idly, the electronic control unit 20 may determine that it is necessary to perform the fuel injection to cause the internal combustion engine 100 to operate continuously.

The electronic control unit 20 performs Step S105 when it is determined in Step S104 that it is necessary to perform the fuel injection, that is, there is an injection request, and ends this routine when it is determined in Step S104 that it is not necessary to perform the fuel injection, that is, there is no injection request.

In Step S105, the electronic control unit 20 calculates the engine rotation speed NE based on the output valve of the crank angle sensor 16 and calculates a required amount of injected fuel Qv based on the output value of the accelerator pedal depression sensor 15.

In Step S106, the electronic control unit 20 calculates the target fuel injection pressure Pinj_t which is a target pressure of fuel supplied to the injector 9. In this embodiment, the electronic control unit 20 calculates the target fuel injection pressure Pinj_t based on the engine rotation speed NE and the required amount of injected fuel Qv with reference to the map which has been prepared by experiment or the like in advance.

In Step S107, the electronic control unit 20 determines whether the pressure intensifier 7 should be driven. In this embodiment, the electronic control unit 20 determines whether the pressure intensifier 7 should be driven with reference to the map of the engine rotation speed NE and the required amount of injected fuel Qv.

Figure 10:
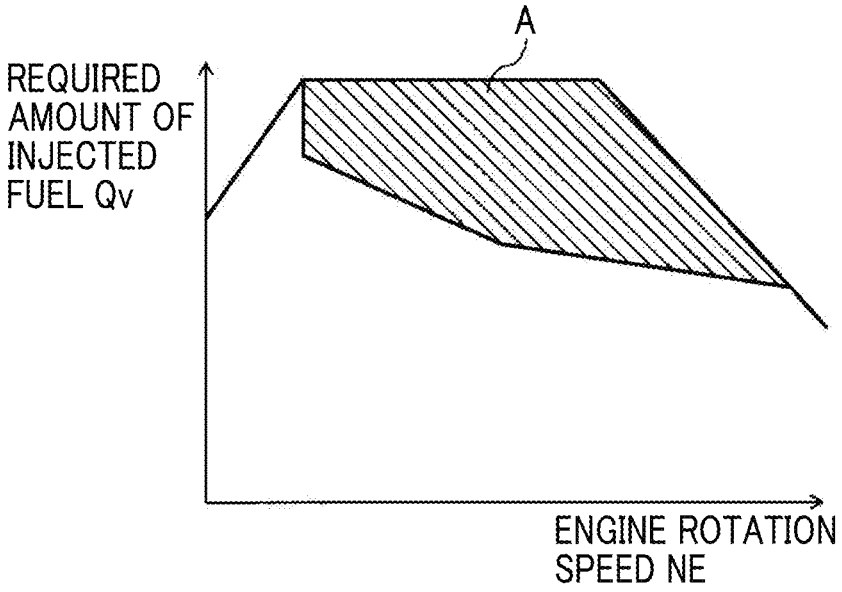
FIG. 10 is a map which is used to determine whether to intensify a pressure according to the first embodiment.

FIG. 10 illustrates a map of the engine rotation speed NE and the required amount of injected fuel Qv which is used to determine whether the pressure intensifier 7 should be driven in this embodiment. In the map, area A in which the pressure intensifier 7 is driven is set. The electronic control unit 20 determines that it is necessary to perform pressure intensification when it is determined that the engine rotation speed NE and the required amount of injected fuel Qv are in area A, and determines that it is not necessary to perform pressure intensification when it is determined that the engine rotation speed NE and the required amount of injected fuel Qv are not in area A.

The electronic control unit 20 performs Step S108 when it is determined in Step S107 that it is necessary to perform pressure intensification, and performs Step S110 when it is determined that it is not necessary to perform pressure intensification.

In Step S108, the electronic control unit 20 sets the target common rail pressure Pcr_t which is a target fuel pressure of the common rail 5. In Step S108, the target common rail pressure Pcr_t is determined in consideration of the decrease in the fuel pressure of the common rail 5 due to driving of the pressure intensifier 7. Details thereof will be described later with reference to FIG. 11.

In Step S109, the electronic control unit 20 sets the operations of the pressure intensifier 7 and the injector 9. Specifically, the electronic control unit 20 adjusts driving times of the pressure intensifier 7 and the injector 9 such that the fuel pressure is intensified to correspond to the time of fuel injection. When the process of Step S109 ends, this routine ends.

In Step S110, the electronic control unit 20 sets the target common rail pressure Pcr_t which is a target fuel pressure of the common rail 5 to the target fuel injection pressure Pinj_t. Since Step S110 is performed when it is determined in Step S107 that it is not necessary to perform the pressure intensification, that is, it is not necessary to drive the pressure intensifier 7, the fuel pressure of the common rail 5 becomes the fuel pressure supplied to the injector 9.

In Step S111, the electronic control unit 20 sets the operation of the injector 9 and ends this routine.

Figure 11:
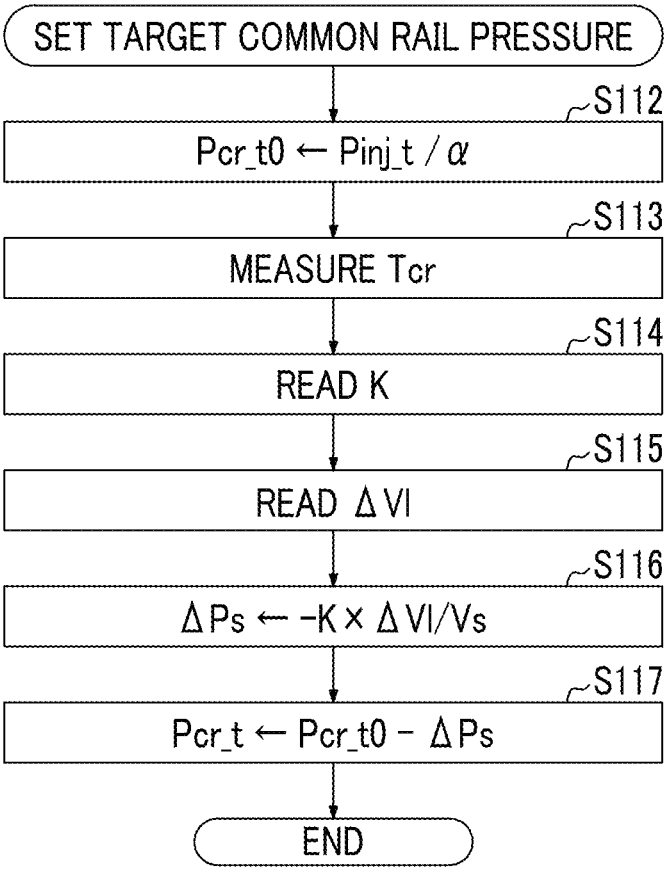
FIG. 11 is a diagram illustrating a target common rail pressure setting routine according to the first embodiment.

The target common rail pressure setting routine according to the first embodiment of the disclosure will be described below. FIG. 11 is a flowchart illustrating the target common rail pressure setting routine according to the first embodiment of the disclosure. The electronic control unit 20 performs this routine whenever Step S108 in FIG. 9 is performed. That is, when it is determined in Step S107 in FIG. 9 that it is necessary to perform the pressure intensification, the electronic control unit 20 performs the target common rail pressure setting routine in FIG. 11 in Step S108.

In Step S112, the electronic control unit 20 sets a temporary target common rail pressure Pcr_t0 which is a temporary target common rail pressure when it is assumed that the fuel pressure of the common rail 5 does not decrease when the pressure intensifier 7 is driven. Specifically, the electronic control unit 20 sets the temporary target common rail pressure Pcr_t0 to a value obtained by dividing the target fuel injection pressure Pinj_t by the pressure intensification ratio $\alpha$.

In Step S113, the electronic control unit 20 acquires the common rail temperature Tcr measured by the common rail temperature sensor 52.

In Step S114, the electronic control unit 20 reads the map of bulk modulus of elasticity K which is stored in the electronic control unit 20 based on the temporary target common rail pressure Pcr_t0 set in Step S112 and the common rail temperature Tcr acquired in Step S113, and calculates the bulk modulus of elasticity K.

In Step S115, the electronic control unit 20 reads the map of the fuel leakage volume $\Delta Vl$ which is stored in the electronic control unit 20 based on the temporary target common rail pressure Pcr_t0 set in Step S112 and the common rail temperature Tcr acquired in Step S113, and calculates the fuel leakage volume ΔVl. The fuel leakage volume ΔVl becomes larger as the temporary target common rail pressure Pcr_t0 becomes higher, and becomes larger as the common rail temperature Tcr becomes higher. In this embodiment, the fuel leakage volume ΔVl is a value which has been acquired by experiment or the like in advance.

In Step S116, the electronic control unit 20 calculates the common rail pressure variation ΔPs which is a variation in pressure of the common rail 5 when the pressure intensifier 7 is driven, in this embodiment, the common rail pressure variation ΔPs is expressed by $\Delta Ps=-K\times\Delta Vl/Vs$. As described above, the common rail pressure fuel volume Vs is a volume of fuel which is maintained at the same pressure as the pressure of common rail 5 before the pressure intensifier 7 is driven.

In Step S117, the electronic control unit 20 subtracts the common rail pressure variation ΔPs from the temporary target common rail pressure Pcr_t0 to calculates the target common rail pressure Pcr_t. Since ΔPs calculated in Step S116 has a negative value, the electronic control unit 20 sets the target common rail pressure Pcr_t to a value greater than the temporary target common rail pressure Pcr_t0.

When Step S117 ends, the electronic control unit 20 ends this routine and performs Step S109 in FIG. 9.

As described above, after the operations of the supply pump 3, the pressure intensifier 7, and the injector 9 are set by the injection setting routine illustrated in FIG. 9, the electronic control unit 20 controls the supply pump 3 such that the pressure of fuel in the common rail 5 reaches the target common rail pressure Pcr_t by the injection control routine illustrated in FIG. 8. After the pressure of fuel in the common rail 5 reaches the target common rail pressure Pcr_t, the electronic control unit 20 supplies fuel with a pressure of the target fuel injection pressure Pinj_t to the injector 9 by controlling the pressure intensifier 7 if necessary.

As described above, in the first embodiment of the disclosure, the internal combustion engine 100 includes the fuel tank 1, the supply pump 3 that increases the fuel pressure of the fuel tank 1, and the common rail 5 (the high-pressure fuel passage) in which fuel of which the pressure is increased by the supply pump 3 flows. The internal combustion engine 100 further includes the pressure intensifier 7 that intensifies the fuel pressure of fuel supplied from the common rail 5, the return passage 10 in which fuel which is not intensified by the pressure intensifier 7 and returned to the aid tank 1 flows to drive the pressure intensifier 7, and the injector 9 (the fuel injector) that injects fuel of which the pressure is increased by the pressure intensifier 7. In the first embodiment of the disclosure, the electronic control unit 20 (the controller for the internal combustion engine) sets the target common rail pressure Pcr_t (the target fuel pressure) which is a target value of the pressure of fuel supplied to the common rail 5 (the high-pressure fuel passage) based on the time t fuel injection pressure Pinj_t (the target injection pressure) which is a target of the pressure of fuel supplied to the injector 9 (the fuel injector). The electronic control unit 20 controls the supply pump 3 such that the measured value Pcr_s of the common rail pressure (the fuel pressure in the high-possum fuel passage) reaches the target common rail pressure Pcr_t (the target fuel pressure), and then drives the pressure intensifier 7. The pressure intensifier 7 includes the three-way valve 77 (the switching device) that switches the state in which the pressure intensifier 7 is connected to the common rail 5 (the high-pressure fuel passage) to the state in which the pressure intensifier 7 is connected to the fuel tank 1 to intensify the pressure of fuel. When the pressure of fuel is intensified using the pressure intensifier 7, the three-way valve 77 (the switching device) switches the state in which the pressure intensifier 7 is connected to the common rail 5 (the high-pressure fuel passage) to the state in which the pressure intensifier 7 is connected to the fuel tank 1. Then, the electronic control unit 20 (the controller for the internal combustion engine) sets the target common rail pressure Pcr_t (the target fuel pressure) to be higher as the fuel leakage volume ΔVl which is a volume of fuel discharged from the common rail 5 (the high-pressure fuel passage) to the fuel tank 1 (the fuel tank) via the three-way valve 77 (the switching device) increases while the three-way valve 77 (the switching device) is performing the switching.

In the first embodiment of the disclosure, the electronic control unit 20 sets the temporary target common rail pressure Pcr_t0 which is a target value of the fuel pressure in the common rail 5 (the high-pressure fuel passage) based on the target fuel injection pressure Pinj_t (the target injection pressure) on the premise that the fuel leakage volume ΔVl is not considered, and sets the target common rail pressure Pcr_t (the target fuel pressure) to be higher than the temporary target common rail pressure Pcr_t0 by correcting the temporary target common rail pressure Pcr_t0 to increase.

Accordingly, since the fuel pressure of the common rail 5 (the high-pressure fuel passage) can be controlled in consideration of a decrease in the fuel pressure in the common rail 5 (the high-pressure fuel passage) due to driving of the pressure intensifier 7, it is possible to enhance control accuracy of the pressure of fuel which is supplied to the injector 9 (the fuel injector).

In the first embodiment, when the pressure of fuel is intensified using the pressure intensifier 7, the electronic control unit 20 (the controller for the internal combustion engine) sets the target common rail pressure Pcr_t (the target fuel pressure) to be higher as the bulk modulus of elasticity K of fuel which is supplied to the internal combustion engine 100 increases.

Accordingly, since the target common rail pressure Pcr_t can be appropriately set depending on the fuel stored in the internal combustion engine 100, it is possible to enhance control accuracy of the pressure of fuel which is supplied to the injector 9.

A second embodiment of the disclosure will be described below. The second embodiment of the disclosure is different from the first embodiment, in that the electronic control unit 20 updates the map of the bulk modulus of elasticity K. Hereinafter, the difference will be mainly described.

As described above, the electronic control unit 20 stores the bulk modulus of elasticity K corresponding to the pressure of fuel in the common rail 5 and the temperature of fuel in the common rail 5 before the pressure intensifier 7 is driven as a map. However, when another type of fuel is supplied, the map of the bulk modulus of elasticity K also varies. Accordingly in the second embodiment of the disclosure, when supply of fuel is performed, it is thought that there is a likelihood of the map of the bulk modulus of elasticity K varying as a result of the supply of another type of fuel, and thus the map of the bulk modulus of elasticity K is updated.

A method of causing the electronic control unit 20 to update the map of the bulk modulus of elasticity K will be first described below.

In the map of the bulk modulus of elasticity K, a plurality of sets of the fuel temperature and the fuel pressure in the common rail 5 are stored, and the bulk modulus of elasticity K is stored for each set of the fuel temperature and the fuel pressure. A set of the fuel temperature and the fuel pressure in the common rail 5 is referred to as an update point. Total n_all update points are present, and an update point number n and a target fuel temperature Tl(n), a target fuel pressure Pl(n), and a bulk modulus of elasticity K(n) corresponding to the update point number n are stored for each update point in the map of the bulk modulus of elasticity K.

In this embodiment, when the map of the bulk modulus of elasticity K is updated, the bulk modulus of elasticity K is calculated in the ascending order of the update point numbers n. At a certain update point number n, when a new bulk modulus of elasticity K(n) is calculated, the stored bulk modulus of elasticity K(n) is rewritten. When the bulk moduli of elasticity K(n) of all the update points are rewritten to new bulk moduli of elasticity K(n), update of the bulk modulus of elasticity K ends.

A method of calculating the bulk modulus of elasticity K at each update point will be described below.

In this embodiment, under the condition that the injector 9 does not inject fuel and the pressure intensifier 7 is not driven, the supply pump 3 is driven to change the volume of fuel in the common rail 5 and the pressure of fuel in the common rail 5. When the volume of fuel supplied to the common rail 5 due to driving of the supply pump 3 is defined as a pump feeding volume $\Delta Vp$ and the variation of the pressure before and after fuel is supplied from the supply pump 3 to the common rail 5 is defined as a common rail pressure variation $\Delta Ps$, $K=-\Delta Ps \times Vs/Vp$ is established and thus it is possible to calculate the bulk modulus of elasticity K.

Since the supply of fuel with a pump feeding volume $\Delta Vp$ to the common rail 5 due to driving of the supply pump 3 means that the volume of fuel decreases, the pump feeding volume $\Delta Vp$ has a negative value.

Control according to the second embodiment will be described below. This control is different from that according to the first embodiment, in that the electronic control unit 20 updates the map of the bulk modulus of elasticity K when fuel is supplied and there is no injection request.

Figure 13:
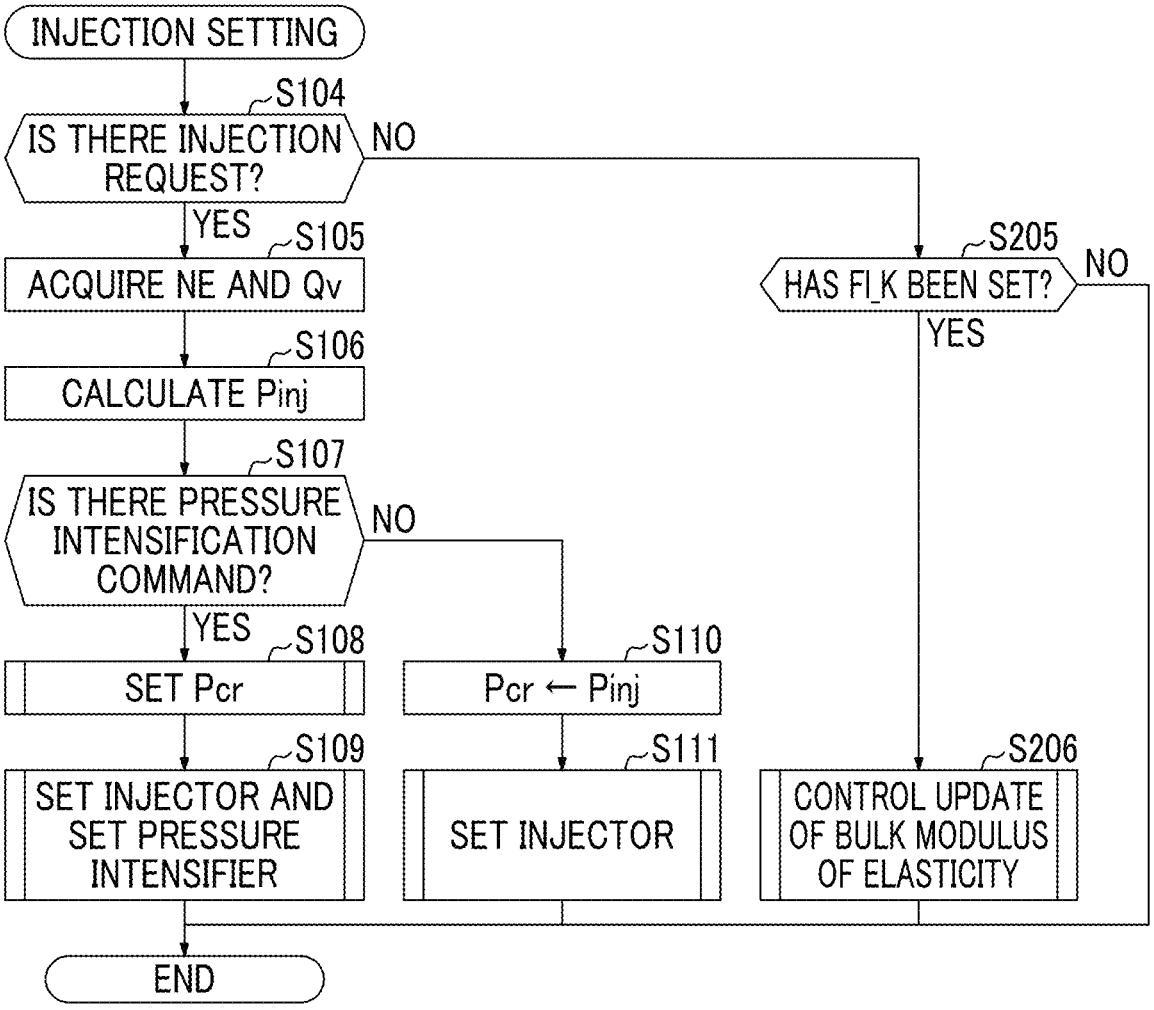
FIG. 13 is a diagram illustrating an injection setting routine according to the second embodiment.
Figure 14:
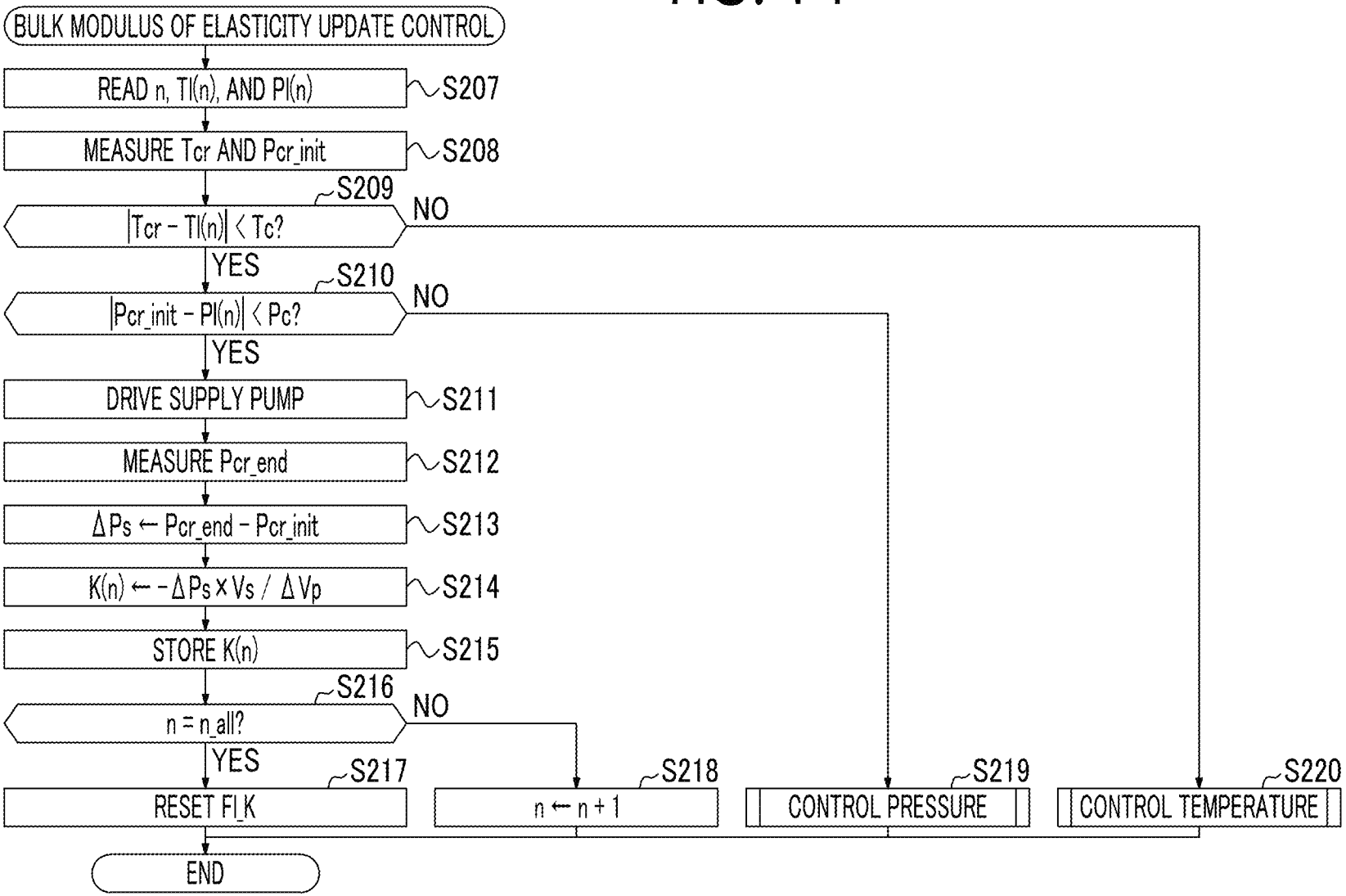
FIG. 14 is a diagram illustrating a bulk modulus of elasticity update control routine according to the second embodiment.

A routine according to the second embodiment includes a fuel injection control routine (FIG. 8), a fuel supply determining routine (FIG. 12), a fuel injection setting routine (FIG. 13), and a bulk modulus of elasticity updating control routine (FIG. 14). In this embodiment, when the electronic control unit 20 determines that supply of fuel has been performed through the fuel supply determining routine and determines that there is no fuel injection request through the fuel injection control routine, the bulk modulus of elasticity K is updated.

Hereinafter, only differences from the first embodiment will be described and common points will not be described.

Figure 12:
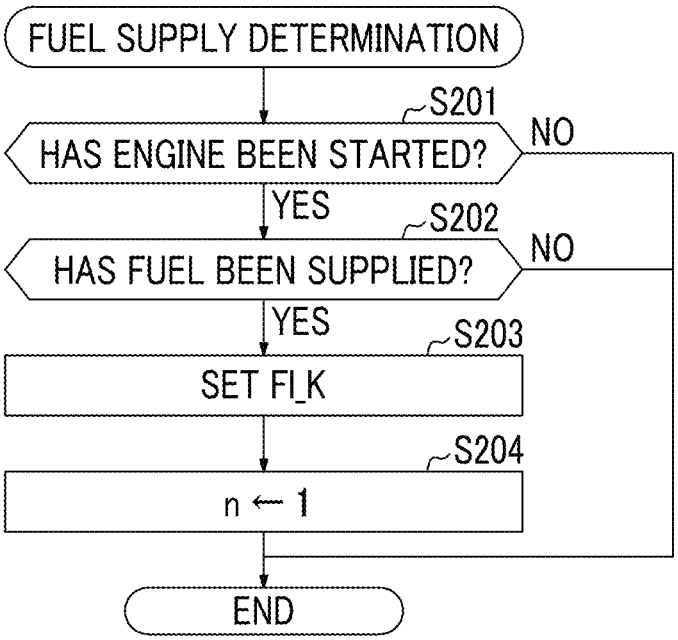
FIG. 12 is a diagram illustrating a fuel supply determining routine according to a second embodiment.

FIG. 12 is a flowchart illustrating a fuel supply determining routine according to the second embodiment. The electronic control unit 20 repeatedly performs this routine at predetermined intervals.

In Step S201, the electronic control unit 20 determines whether the internal combustion engine 100 has been switched from a stopped state to an operating state, that is, whether a starting operation of the internal combustion engine 100 has been performed. For example, the electronic control unit 20 determines whether a state in which an ignition switch of the internal combustion engine 100 has been switched from an OFF state to an ON state. The electronic control unit 20 performs Step S202 when it is determined that the starting operation of switching the internal combustion engine 100 from the stopped state to the operating state has been preformed, and ends this routine when it is determined that the internal combustion engine 100 is maintained in the stopped state or when it is determined that the operating state is maintained and the starting, operation of the internal combustion engine has not been performed.

In Step S202, the electronic control unit 20 determines whether fuel has been supplied to the internal combustion engine 100. For example, the electronic: control unit 20 compares an amount of fuel which is stored in the fuel tank 1 when the ignition switch of the internal combustion engine 100 has been switched to the OFF state with an amount of fuel which is stored in the fuel tank 1 at the current time and determines that supply of fuel has been performed when the amount of fuel increases. The electronic control unit 20 performs Step S203 when it is determined that the supply fuel has been performed, and ends this routine when it is determined that the supply of fuel has not been performed.

In Step S203, the electronic control unit 20 sets a bulk modulus of elasticity learning flag Fl_K which is set when the map of the bulk modulus of elasticity K is updated. The initial state of the bulk modulus of elasticity learning flag Fl_K is a reset state, and the bulk modulus of elasticity learning flag Fl_K is set only when it is determined that it is necessary to update the map of the bulk modulus of elasticity K.

In Step S204, the electronic control unit 20 substitutes 1 for the update point number n. That is, the electronic control unit 20 starts updating from the first update, point. When the process of Step S204 ends, the electronic control unit 20 ends this routine.

FIG. 13 is a flowchart illustrating the injection control routine according to the second embodiment. The electronic control unit 20 repeatedly performs this routine at predetermined intervals.

In Step S104, the electronic control unit 20 determines whether there is an injection request, similarly to the first embodiment. Step S105 is performed when the electronic control unit 20 determines that there is an injection request, and Step S205 is performed when the electronic control unit 20 determines that there is no injection request. The control subsequent to Step S105 is the same as in the first embodiment and thus description thereof will be omitted.

In Step S205, the electronic control unit 20 determines whether the bulk modulus of elasticity learning flag Fl_K which is set when the map of the bulk modulus of elasticity K is updated has been set. The electronic control unit 20 performs Step S206 when the bulk modulus of elasticity learning flag Fl_K has been set, and ends this routine when the bulk modulus of elasticity learning flag Fl_K has not been set.

In Step S206, the electronic control unit 20 updates the map of the bulk modulus of elasticity K. Details thereof will be described later with reference to the flowchart illustrated FIG. 14. The electronic control unit 20 ends this routine after the process of Step S206 ends.

When the electronic control unit 20 ends the process of Step S206, it does not mean that updating of the map of the bulk modulus of elasticity K ends. That is, the electronic control unit 20 repeatedly performs Step S206 while there is no injection request and the bulk modulus of elasticity learning flag Fl_K is set, and ends updating of the map of the bulk modulus of elasticity K when the bulk modulus of elasticity learning flag Fl_K is reset.

FIG. 14 is a flowchart illustrating the bulk modulus of elasticity update control routine according to the second embodiment. The electronic control unit 20 performs this routine whenever Step S206 in FIG. 13 is performed.

In Step S207, the electronic control unit 20 reads the update point to be updated hi the next time and thus reads the update point number n. Subsequently, the electronic control unit 20 reads the target fuel temperature Tl(n) which is a target temperature of fuel in the common rail 5 and the target fuel pressure Pl(n) which is a target pressure of fuel in the common rail 5 to correspond to the update point number n.

In Step S208, the electronic control unit 20 acquires, a common rail temperature Tcr measured by the common rail temperature sensor 52 and a common rail pressure (hereinafter referred to as a "pre-compression common rail pressure") Pcr_init which is measured by the common rail pressure sensor 51 before the supply pump 3 is driven.

In Step S209, the electronic control unit 20 determines whether an absolute value |Tcr−Tl(n)| of a difference between the common rail temperature Tcr and the target fuel temperature Tl(n) is less than an allowable temperature difference Tc which is an allowable range of the difference of the temperature. When |Tcr−Tl(n)| is less than the allowable temperature difference Tc, the electronic control unit 20 determines that the temperature of the common rail 5 sufficiently approaches the target temperature for measuring the bulk modulus of elasticity K aid performs Step S210. On the other hand, when |Tcr−Tl(n)| is equal to or greater than the allowable temperature difference Tc, the electronic control unit 20 determines that the temperature of the common rail 5 is separated from the target temperature for measuring the bulk modulus of elasticity K and performs Step S220.

In Step S210, the electronic control unit 20 determines whether an absolute value (|Pcr_ini−Pl(n)|) of the difference between the pre-compression common rail pressure Pct_init and the target fuel pressure Pl(n) is less than an allowable pressure difference Pc which is an allowable range of the pressure difference. When |Pcr_init−Pl(n)| is less than the allowable pressure difference Pc, the electronic control unit 20 performs Step S211. On the other hand, when |Pcr_init−Pl(n)| is equal to or greater than the allowable pressure difference Pc, the electronic control unit 20 performs Step S219.

In Step S211, the electronic control unit 20, drives the supply pump 3 without performing injection of fuel from the injector 9 and driving the pressure intensifier 7, and supplies fuel to the common rail 5. The volume of fuel supplied to the common rail 5 is the pump feeding volume ΔVp. By supplying fuel from the supply pump 3 to the common rail 5, the volume of fuel decreases by the pump feeding volume ΔVp.

In Step S212, the electronic control unit 20 acquires a common rail pressure (hereinafter referred to as a "post-compression common rail pressure") Pcr_end which is measured by the common rail pressure sensor 51 after the supply pump 3 is driven.

In Step S213, the electronic control unit 20 calculates the common rail pressure variation ΔPs which a pressure difference between the post-compression common rail pressure Pcr_end and the pre-compression common rail pressure Pcr_init. The common rail pressure variation ΔPs is acquired by subtracting the pre-compression common rail pressure Pcr_init from the post-compression common rail pressure Pcr_end.

In Step S214, the electronic control unit 20 calculates K(n) which is the bulk modulus of elasticity K at the update point number n. In this embodiment, the electronic control unit 20 substitutes −ΔPs×Vs/Vp into K(n).

In Step S215, the electronic control unit 20 stores K(n) calculated in Step S210.

In Step S216, when a predetermined total number of update points is defined as the total number of update points n_all, the electronic control unit 20 determines whether the update point number n is the same n_all. When it is determined that n is equal to n_all the electronic control unit 20 determines that K(n) is calculated at all the predetermined update points, and performs Step S217. On the other hand, when n is different from n_all, the electronic control unit 20 determines that n is less than n_all, that is, that an update point remains yet, and performs Step S218.

In Step S217, the electronic control unit 20 determines that the bulk modulus of elasticity K is calculated at all the update points, resets the bulk modulus of elasticity learning flag Fl_K to end updating of the map of the bulk modulus of elasticity K, and ends this routine. When the electronic control unit 20 ends this routine, the injection setting routine illustrated in FIG. 13 also ends.

In Step S218, the electronic control unit 20 increases n to set a next update point and ends this routine. When the electronic control unit 20 ends this routine, the injection setting routine illustrated in FIG. 13 also ends.

In Step S219, the electronic control unit 20 controls the fuel pressure in the common rail 5 such that the pre-compression common nail pressure Pcr_init approaches the target fuel pressure Pl(n). In this embodiment, when the fuel pressure in the common rail 5 is increased, an amount of fuel supplied from the supply pump 3 to the common rail 5 is increased. When the fuel pressure in the common rail 5 is decreased, the decompression valve 54 is opened to discharge fuel in the common rail 5 to the fuel tank 1. When the electronic control unit 20 ends the process of Step S219, this routine also ends, and the injection setting routine illustrated in FIG. 13 also ends.

In Step S220, the electronic control unit 20 controls the fuel temperature of the common rail 5 such that the common rail temperature Tcr approaches the target fuel temperature Tl(n). In this embodiment, when the fuel temperature is increased, the electronic control unit 20 heats the fuel using the heater 53 disposed in the common rail 5. When the fuel temperature is increased, the electronic control unit 20 decreases the fuel temperature by opening the decompression valve 54 to discharge fuel from the common rail 5 via the decompression passage 12 and to circulate the fuel. When the electronic control unit 20 ends the process of Step S220, this routine ends and the injection setting routine illustrated in FIG. 13 also ends.

In this embodiment, the bulk modulus of elasticity K is handled as a function of the fuel temperature and the fuel pressure, but the bulk modulus of elasticity K may be handled as a function of only one of the temperature of fuel in the common rail 5 and the pressure of fuel in the common rail 5. In this case, since the number of update points n_all of the bulk modulus of elasticity K can be decreased, it is possible to reduce a control time for update.

As described above, in the second embodiment of the disclosure, the electronic control unit 20 stores the map of the bulk modulus of elasticity in which the bulk modulus of elasticity K corresponding to at least one of the common rail temperature Tcr (the temperature of fuel in the high-pressure fuel passage) and the measured value Pcr_s of the common rail pressure (the pressure of fuel in the high-pressure fuel passage) is stored. When fuel is supplied to the fuel tank 1, the electronic control unit 20 updates the map of the bulk modulus of elasticity K.

Accordingly even when the bulk modulus of elasticity K of fuel is changed by supply of fuel, the electronic control unit 20 can determine the target common rail pressure Pcr_t in consideration of the change of the bulk modulus of elasticity K and thus it is possible to accurately control the pressure of fuel supplied to the injector 9.

A third embodiment of the disclosure will be described below. The third embodiment of the disclosure is different from the above-mentioned embodiments, in that the electronic control unit 20 updates the map of the fuel leakage volume ΔVl which is a volume of fuel leaking from the common rail 5 to the fuel tank 1 at the time of driving of the pressure intensifier 7. Hereinafter, the difference will be mainly described.

As described above, the electronic control unit 20 stores the fuel leakage volume ΔVl corresponding to the pressure of fuel in the common rail 5 and the temperature of fuel in the common rail 5 before the pressure intensifier 7 is driven as a map. However, when another type of fuel is supplied, characteristics such as viscosity of fuel are changed and the value of the fuel leakage volume ΔVl with respect to the temperature of fuel in the common rail 5 and the pressure of fuel in the common rail 5 is changed. That is, since the map of the fuel leakage volume ΔVl is changed, the map of the fuel leakage volume ΔVl is updated by updating the fuel leakage volume ΔVl when supply of fuel is performed.

A method of updating the map of the fuel leakage volume ΔVl according to this embodiment will be described below. The fuel leakage volume ΔVl cannot be directly measured, but a return volume ΔVr which is an amount of fuel flowing into the fuel tank 1 while the pressure intensifier 7 is being driven can be directly measured. In this embodiment, the electronic control unit 20 measures the return volume ΔVr using the fuel level sensor 13 disposed in the fuel tank 1. In addition, the return volume ΔVr may be measured using a flow meter that measures an amount of fuel flowing, in the return passage 10 disposed in the tube of the return passage 10.

The return volume ΔVr is a total sum of the fuel leakage volume ΔVl which is a volume of fuel leaking from the common rail 5 and a decompression-area volume variation ΔVa which is a volume of fuel discharged from the pressure intensification control chamber 75. Accordingly, the decompression-area volume variation ΔVa can be calculated so as to calculate the fuel leakage volume ΔVl.

Similarly to the fuel leakage volume ΔVl, the decompression-area volume variation ΔVa can be expressed using the bulk modulus of elasticity K. That is, a phenomenon in which fuel filled in the pressure intensification control chamber 75, the second three-way valve passage 79, and the fuel chamber 777 expands due to driving of the pressure intensifier 7 is applied to the equation $\Delta P=-K\times\Delta V/V0$.

The volume corresponding to V0 in the above-mentioned equation is a volume Va of the decompression area which is a value of fuel filled in the pressure intensification control chamber 75, the second three-way valve passage 79, and the fuel chamber 777 before the pressure intensifier 7 is driven. The pressure variation corresponding to ΔP in the equation is a difference between the fuel pressure in the pressure intensification control chamber 75 before the pressure intensifier 7 is driven and the fuel pressure in the pressure intensification control chamber 75 after the pressure intensifier 7 is driven. That is, a decompression-area pressure variation ΔPa which is a pressure difference obtained by subtracting the pressure of fuel in the common rail 5 from the pressure of fuel stored in the fuel tank 1 corresponds to ΔP. In this embodiment, since the pressure in the fuel tank 1 is the atmospheric pressure, the pressure of fuel stored in the fuel tank 1 is also the atmospheric pressure. The volume variation corresponding to ΔV in the above-mentioned equation is a volume of fuel discharged from the pressure intensification control chamber 75 to the fuel tank 1, that is, the decompression-area volume variation ΔVa. In this case, the decompression-area volume variation ΔVa satisfies a relationship of $\Delta Va=-Va-\Delta Pa/K$. Since the volume of the decompression area Va, the decompression-area pressure variation ΔPa, and the bulk modulus of elasticity K are all measurable quantities, the electronic control unit 20 can calculate the volume of the decompression area Va.

As described above, the electronic control unit 20 calculates the return volume ΔVr and the decompression-area volume variation ΔVa by driving the pressure intensifier 7 without injecting fuel from the injector 9, and calculates the fuel leafage volume ΔVl by subtracting the decompression-area volume variation ΔVa from the return volume ΔVr.

As can be apparently seen from the second embodiment, the value of the bulk modulus of elasticity K varies when the fuel temperature and the fuel pressure in the common rail 5 vary. Accordingly, the fuel leakage volume ΔVl which is expressed using the bulk modulus of elasticity K also varies depending on the fuel temperature and the fuel pressure in the common rail 5. Accordingly, the electronic control unit 20 calculates the fuel leakage volume ΔVl. For each fuel temperature and each fuel pressure in the common rail 5 before the pressure intensifier 7 is driven, and updates the map of the fuel leakage volume ΔVl.

Control according to the third embodiment will be described below. The third embodiment is different from the second embodiment, in that the electronic control unit 20 updates the map of the fuel leakage volume ΔVl by driving the pressure intensifier 7 when fuel is supplied and there is no injection request.

Figure 16:
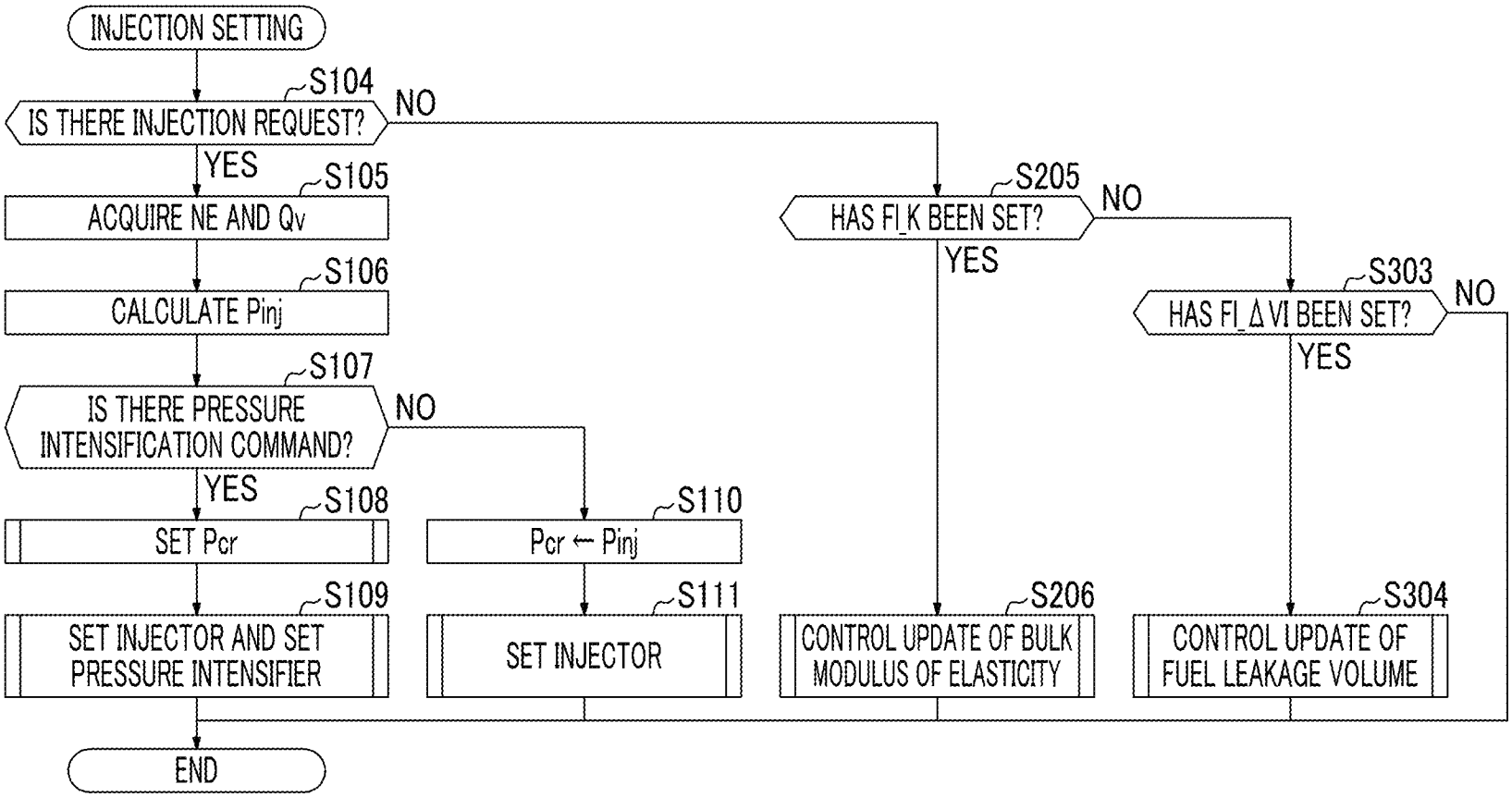
FIG. 16 is a diagram illustrating an injection setting routine according to the third embodiment.
Figure 17:
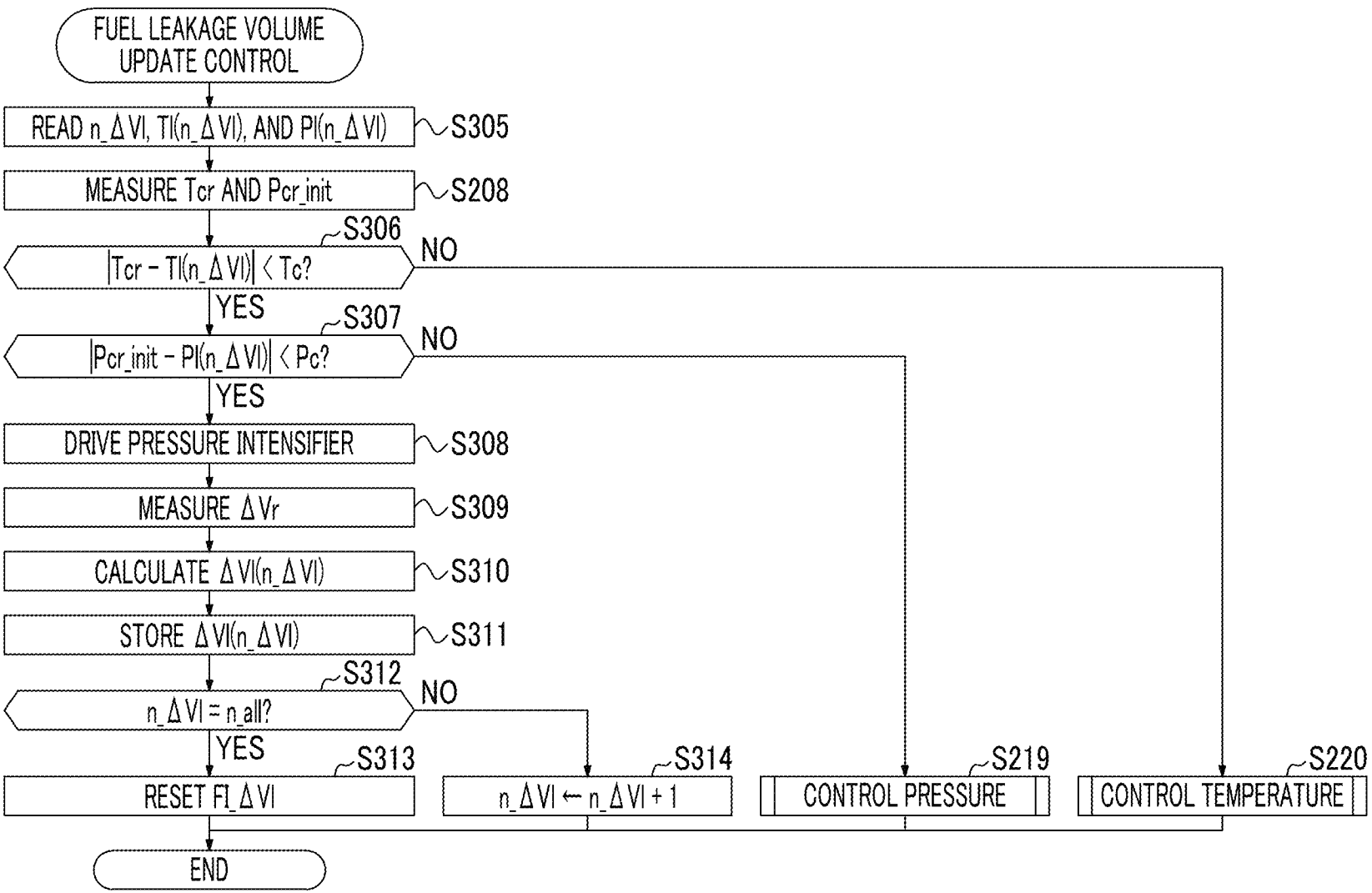
FIG. 17 is a diagram illustrating a fuel leakage volume update control routine according to the third embodiment.

A routine according to the third embodiment includes a fuel injection control routine (FIG. 8), a fuel supply determining routine (FIG. 15), a fuel injection setting routine (FIG. 16), a bulk modulus of elasticity updating control routine (FIG. 14), and a fuel leakage volume updating control routine (FIG. 17). In this embodiment, when the electronic control unit 20 determines that supply of fuel has been performed through the fuel supply determining routine and determines that there is no fuel injection request through the fuel injection control routine, the fuel leakage volume ΔVl is updated. Hereinafter, only differences from the second embodiment will be described and common points will not be described.

Figure 15:
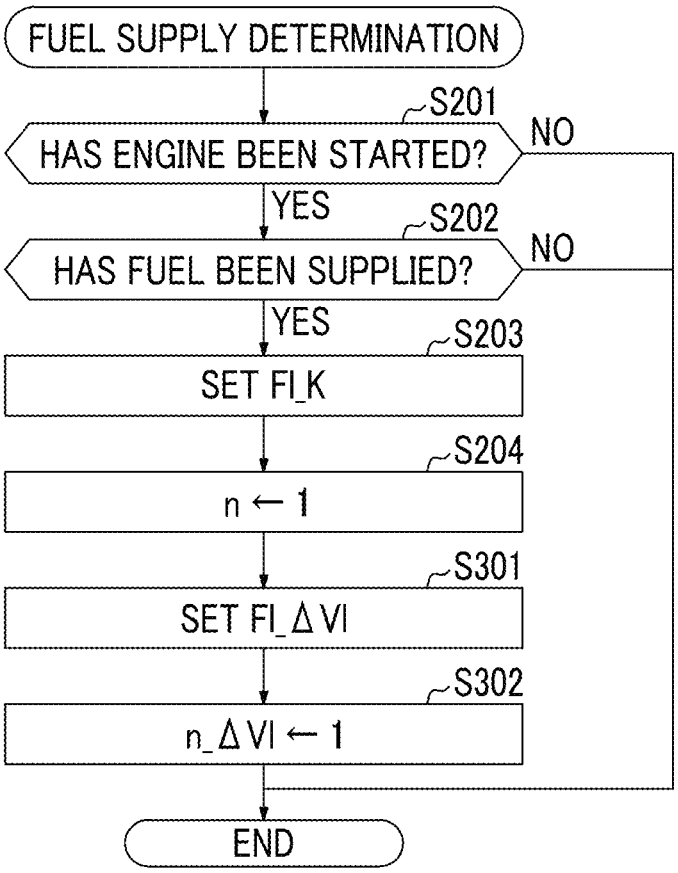
FIG. 15 is a diagram illustrating a fuel supply determining routine according to a third embodiment.

FIG. 15 is a flow/chart illustrating the fuel supply determining routine according to the third embodiment. The electronic control unit 20 repeatedly performs this routine at predetermined intervals.

The processes of Steps S201 to S204 are the same as in the second embodiment and description thereof will not be repeated.

When the process of Step S204 ends, the electronic control unit 20 performs Step S301.

In Step S301, the electronic control unit 20 sets a fuel leakage volume learning flag Fl_ΔVl which is set when the map of the fuel leakage volume ΔVl is updated. The initial state of the fuel leakage volume learning flag Fl_ΔVl is a reset state, and the fuel leakage volume learning flag Fl_ΔVl is set only when it is determined that it is necessary to update the map of the fuel leakage volume ΔVl.

In Step S302, the electronic control unit 20 substitutes 1 into a fuel leakage volume learning point number n_ΔVl. In this embodiment, the fuel leakage volume learning point number n_ΔVl is prepared as a numerical value which is independent from the update point number n. When the process of Step S302 ends, the electronic control unit 20 ends this routine.

FIG. 16 is a flowchart illustrating the injection control routine according to the third embodiment. The electronic control unit 20 repeatedly performs this routine at predetermined intervals.

When the electronic control unit 20 determines that there is no injection request in Step S104 and determines that the bulk modulus of elasticity learning flag Fl_K is not set in Step S205, the routine transitions to Step S303. When the electronic control unit 20 determines that there is an injection request in Step S104 or determines that Fl_K is set in Step S205, the electronic control unit 20 performs the same process as in the second embodiment and thus description thereof will not be repeated.

In Step S303, the electronic control unit 20 determines whether the fuel leakage volume learning flag Fl_ΔVl has been set which is set when the map of the fuel leakage volume ΔVl is updated. The electronic control unit 20 performs Step S304 when the fuel leakage volume learning flag Fl_ΔVl has been set, and the electronic control unit 20 ends this routine when the fuel leakage volume learning flag Fl_ΔVl has not been set in Step S304.

In Step S304, the electronic control unit 20 updates the map of the fuel leakage volume ΔVl. Details thereof will be described later with reference to the flowchart illustrated FIG. 16. When the process of Step S304 ends, this routine also ends.

In this embodiment, the electronic control unit 20 updates the map of the fuel leakage volume ΔVl under the condition that updating of the map of the bulk modulus of elasticity K ends. When the updated bulk modulus of elasticity K is used to calculate the fuel leakage volume ΔVl, it is possible to more accurately calculate the fuel leakage volume ΔVl and it is thus preferable that the bulk modulus of elasticity K be updated earlier than the fuel leakage volume ΔVl.

In this embodiment, ail the update points for the fuel leakage volume ΔVl are updated after all the update points for the bulk modulus of elasticity K have been updated, but a certain update point for the bulk modulus of elasticity K is first updated and then the fuel leakage volume ΔVl at the same update point may be updated.

FIG. 17 is a flowchart illustrating an update control routine for the fuel leakage volume ΔVl according to the third embodiment. The electronic control unit 20 performs this routine whenever Step S304 is performed.

In Step S305, the electronic control unit 20 reads the stored fuel leakage volume learning point number n_ΔVl. The fuel leakage volume learning point number n_ΔVl is a numerical value indicating that the update point which is now updated among predetermined update points is a n_ΔVl-th update point. Subsequently, the electronic control unit 20 reads the target fuel temperature Tl(n_ΔVl) which is the target temperature of fuel in the common rail 5 and the target fuel pressure Pl(n_ΔVl) which is the target pressure of fuel in the common rail 5 to correspond to the update point number n_ΔVl.

In Step S208, the electronic control unit 20 acquires the common rail temperature Tcr which is measured by the common rail temperature sensor 52 and the pre-compression common rail pressure Pcr_init which is measured by the common rail pressure sensor 51.

In Step S306, similarly to S209 in the second embodiment, the electronic control unit 20 determines whether |Tcr−Tl(n_ΔVl)| is less than the allowable temperature difference Tc. When it is determined that |Tcr−Tl(n_ΔVl)| is less than the allowable temperature difference Tc, the electronic control unit 20 determines that the temperature of the common rail 5 sufficiently approaches the target temperature for measuring the bulk modulus of elasticity K and performs Step S307. On the other hand, when it is determined that |Tcr−Tl(n_ΔVl)| is equal to or greater than the allowable temperature difference Tc, the electronic control unit 20 determines that the temperature of the common rail 5 is separated, away from the target temperature for measuring the bulk modulus of elasticity K and performs Step S220.

In Step S307, similarly to Step S210 in the second embodiment, the electronic control unit 20 determines whether |Pcr_init−Pl(n_ΔVl) is less than the allowable pressure difference Pc. When it is determined that |Pcr_init−Pl(n_ΔVl)| is less than the allowable pressure difference Pc, the electronic control unit 20 performs Step S308. On the other hand, when it is determined that |Pcr_init−Pl(n_ΔVl)| is equal to or greater than the allowable pressure difference Pc, the electronic control unit 20 performs Step S219.

In Step S308, the electronic control unit 20 drives the pressure intensifier 7 to calculate the fuel leakage volume ΔVl. When the pressure intensifier 7 is driven, some fuel in the common rail 5 leaks to the fuel tank 1.

In Step S309, the electronic control unit 20 measures and records the return volume ΔVr. In this embodiment, the electronic control unit 20 calculates a variation of fuel in the fuel tank 1 by measuring an amount of fuel stored in the fuel tank 1 before Step S308 is performed and an amount of fuel stored in the fuel tank 1 after driving of the pressure intensifier 7 ends using the fuel level sensor 13.

In Step S310, the electronic control unit 20 calculates the fuel leakage volume ΔVl based on the return volume ΔVr. In this embodiment, the electronic control unit 20 calculates a decompression-area pressure variation ΔPa which is a difference between the pressure of fuel in the pressure intensification control chamber 75 after the pressure intensifier 7 has been driven, that is, the pressure of fuel in the fuel tank 1, and the pre-decompression common rail pressure Pcr_init which is the pressure of fuel in the pressure intensification control chamber 75 before the pressure intensifier 7 is driven. Subsequently, the electronic control unit 20 reads the volume Va of the decompression area stored in advance and calculates the decompression-area volume variation ΔVa of fuel discharged from the pressure intensification control chamber 75 to the fuel tank 1. Then, the electronic control unit 20 calculates the fuel leakage volume ΔVl using the relationship of ΔVl=ΔVr−ΔVa.

In Step S311, the electronic control unit 20 stores the calculated fuel leakage volume ΔVl.

In Step S312, the electronic control unit 20 determines whether the update point number n_ΔVl is the same as n_all, where the total number of update points is defined as the total number of update points n_all. In this embodiment, since the update points for updating the map of the bulk modulus of elasticity K and the update points for updating the map of fuel leakage volume ΔVl are the same, the values of the total number of update points n_all are the same.

When it is determined that n_ΔVl is equal to the electronic control unit 20 determines that ΔVl(n_ΔVl) has been calculated at all the predetermined update points and performs Step S313. On the other hand, when it is determined that n_ΔVl is not equal to the electronic control unit 20 performs Step S314.

In Step S313, the electronic control unit 20 resets the fuel leakage volume learning flag Fl_ΔVl to end updating of the map of the fuel leakage volume ΔVl at all the update points and ends this routine. When the electronic control unit 20 ends this routine, the injection setting routine illustrated in FIG. 16 also ends.

In Step S314, the electronic control unit 20 increases n_ΔVl to set a next update point and then ends this routine. When the electronic control unit 20 ends this routine, the injection setting routine illustrated in FIG. 16 also ends.

In this embodiment, the fuel leakage volume ΔVl is handled as a function of the temperature of fuel and the pressure of fuel, but the fuel leakage volume ΔVl may be handled as a function of only one of the temperature of fuel in the common rail 5 and the pressure of fuel in the common rail 5. In this case, since the number of update points n_all of the fuel leakage volume ΔVl can be decreased, it is possible to reduce a control time for update.

As described above, in the third embodiment of the disclosure, the electronic control unit 20 (the controller for the internal combustion engine) stores the map of the fuel leakage volume ΔVl in which the fuel leakage volume ΔVl corresponding to at least one of the common rail temperature Tcr (the temperature of fuel in the high-pressure fuel passage) and the measured value Pcr_s of the common rail pressure (the pressure of fuel in the high-pressure fuel passage) is stored. The electronic control unit 20 (the controller for the internal combustion engine) updates the map of the fuel leakage volume ΔVl when fuel is supplied to the fuel tank 1.

Accordingly, even when the fuel leakage volume ΔVl of fuel varies due to supply of fuel, the electronic control unit 20 can determine the target common rail pressure Pcr_t in consideration of the variation of the fuel leakage volume ΔVl and thus it is possible to accurately control the pressure of fuel supplied to the injector 9.

What is claimed is:

1. An apparatus comprising a controller and an internal combustion engine, the internal combustion engine including a fuel tank, a supply pump configured to increase a pressure of fuel that is supplied from the fuel tank, a high-pressure fuel passage configured to allow the fuel of which the pressure has been increased by the supply pump to flow, a pressure intensifier configured to intensify the pressure of fuel supplied from the high-pressure fuel passage, a low-pressure fuel passage configured to allow fuel, that is not intensified by the pressure intensifier and returned to the fuel tank, to flow in order to drive the pressure intensifier, a switching device disposed in the pressure intensifier and configured to switch a state in which the pressure intensifier is connected to the high-pressure fuel passage to a state in which the pressure intensifier is connected to the fuel tank in order to intensify fuel, wherein the switching device includes a three-way valve that is connected to the high-pressure fuel passage and the fuel tank, and a fuel injector configured to inject fuel of which the pressure has been intensified by the pressure intensifier, the controller comprising:

an electronic control unit configured to set a target fuel pressure that is a target value of the pressure of fuel supplied to the high-pressure fuel passage based on a target injection pressure that is a target value of the pressure of fuel supplied to the fuel injector;

the electronic control unit configured to control the supply pump such that the pressure of fuel in the high-pressure fuel passage reaches the target fuel pressure and then to drive the pressure intensifier; and the electronic control unit configured to set the target fuel pressure to be higher as a fuel leakage volume during a predetermined period of time when the pressure of fuel is intensified by the pressure intensifier becomes larger, the predetermined period of time being a period of time until the switching device switches the state in which the pressure intensifier is connected to the high-pressure fuel passage to the state in which the pressure intensifier is connected to the fuel tank, and the fuel leakage volume being a volume of fuel that leaks from the high-pressure fuel passage to the fuel tank via the switching device.

2. The apparatus according to claim 1, wherein:

the electronic control unit is configured to set a temporary target fuel pressure that is the target value of the fuel pressure in the high-pressure fuel passage based on the target injection pressure on the premise that the fuel leakage volume is not considered, and the electronic control unit is configured to set the target fuel pressure to be higher by correcting the temporary target fuel pressure such that the temporary target fuel pressure increases as the fuel leakage volume becomes larger.

3. The apparatus according to claim 1, wherein:

the electronic control unit is configured to set the target fuel pressure to be higher as a bulk modulus of elasticity of fuel supplied to the internal combustion engine becomes larger when the pressure of fuel is intensified by the pressure intensifier.

4. The apparatus according to claim 1, wherein:

the electronic control unit is configured to store a map of a bulk modulus of elasticity in which the bulk modulus of elasticity corresponding to at least one of a temperature of fuel in the high-pressure fuel passage and the pressure of fuel in the high-pressure fuel passage is stored and to calculate a bulk modulus of elasticity of the fuel based on the map of the bulk modulus of elasticity, and the electronic control unit is configured to update the map of the bulk modulus of elasticity when fuel is supplied to the fuel tank.

5. The apparatus according to claim 1, wherein:

the electronic control unit is configured to store a map of the fuel leakage volume in which the fuel leakage volume corresponding to at least one of a temperature of fuel in the high-pressure fuel passage and the pressure of fuel in the high-pressure fuel passage is stored and to calculate the fuel leakage volume based on the map of the fuel leakage volume, and the electronic control unit is configured to update the map of the fuel leakage volume when fuel is supplied to the fuel tank.

6. An internal combustion engine comprising:

a fuel tank;

a supply pump configured to increase a pressure of fuel that is supplied from the fuel tank;

a high-pressure fuel passage configured to allow the fuel of which the pressure has been increased by the supply pump to flow;

a pressure intensifier configured to intensify the pressure of fuel supplied from the high-pressure fuel passage;

a low-pressure fuel passage configured to allow fuel, that is not intensified by the pressure intensifier and returned to the fuel tank, to flow in order to drive the pressure intensifier;

a switching device disposed in the pressure intensifier and configured to switch a state in which the pressure intensifier is connected to the high-pressure fuel passage to a state in which the pressure intensifier is connected to the fuel tank in order to intensify fuel, wherein the switching device includes a three-way valve that is connected to the high-pressure fuel passage and the fuel tank;

a fuel injector configured to inject fuel of which the pressure has been intensified by the pressure intensifier; and an electronic control unit, the electronic control unit configured to set a target fuel pressure that is a target value of the pressure of fuel supplied to the high-pressure fuel passage based on a target injection pressure that is a target value of the pressure of fuel supplied to the fuel injector, the electronic control unit configured to control the supply pump such that the pressure of fuel in the high-pressure fuel passage reaches the target fuel pressure and then to drive the pressure intensifier, and the electronic control unit configured to set the target fuel pressure to be higher as a fuel leakage volume during a predetermined period of time when the pressure of fuel is intensified by the pressure intensifier becomes larger, the predetermined period of time being a period of time until the switching device switches the state in which the pressure intensifier is connected to the high-pressure fuel passage to the state in which the pressure intensifier is connected to the fuel tank, and the fuel leakage volume being a volume of fuel that leaks from the high-pressure fuel passage to the fuel tank via the switching device.

7. A control method of an internal combustion engine, the internal combustion engine including a fuel tank, a supply pump configured to increase a pressure of fuel that is supplied from the fuel tank, a high-pressure fuel passage configured to allow the fuel of which the pressure has been increased by the supply pump to flow, a pressure intensifier configured to intensify the pressure of fuel supplied from the high-pressure fuel passage, a low-pressure fuel passage configured to allow fuel, that is not intensified by the pressure intensifier and returned to the fuel tank, to flow in order to drive the pressure intensifier, a switching device disposed in the pressure intensifier and configured to switch a state in which the pressure intensifier is connected to the high-pressure fuel passage to a state in which the pressure intensifier is connected to the fuel tank in order to intensify fuel, wherein the switching device includes a three-way valve that is connected to the high-pressure fuel passage and the fuel tank, a fuel injector configured to inject fuel of which the pressure has been intensified by the pressure intensifier, and an electronic control unit, the control method comprising:

setting, by the electronic control unit, a target fuel pressure that is a target value of the pressure of fuel supplied to the high-pressure fuel passage based on a target injection pressure that is a target value of the pressure of fuel supplied to the fuel injector;

controlling, by the electronic control unit, the supply pump such that the pressure of fuel in the high-pressure fuel passage reaches the target fuel pressure and then to drive the pressure intensifier; and setting, by the electronic control unit, the target fuel pressure to be higher as a fuel leakage volume during a predetermined period of time when the pressure of fuel is intensified by the pressure intensifier becomes larger, the predetermined period of time being a period of time until the switching device switches the state in which the pressure intensifier is connected to the high-pressure fuel passage to the state in which the pressure intensifier is connected to the fuel tank, and the fuel leakage volume being a volume of fuel that leaks from the high-pressure fuel passage to the fuel tank via the switching device.

* * * * *